US009968828B2

(12) United States Patent
Tachibana et al.

(10) Patent No.: US 9,968,828 B2
(45) Date of Patent: May 15, 2018

(54) COLORED GOLF BALL

(71) Applicant: DUNLOP SPORTS CO. LTD., Chuo-ku, Kobe-shi, Hyogo (JP)

(72) Inventors: Kosuke Tachibana, Kobe (JP); Keiji Ohama, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 691 days.

(21) Appl. No.: 13/690,651

(22) Filed: Nov. 30, 2012

(65) Prior Publication Data

US 2013/0095954 A1 Apr. 18, 2013

Related U.S. Application Data

(62) Division of application No. 12/721,220, filed on Mar. 10, 2010.

(51) Int. Cl.

| | |
|---|---|
| ***A63B 37/04*** | (2006.01) |
| ***A63B 37/00*** | (2006.01) |
| ***A63B 43/00*** | (2006.01) |

(52) U.S. Cl.

CPC ..... *A63B 37/0075* (2013.01); *A63B 37/0003* (2013.01); *A63B 37/0097* (2013.01); *A63B 43/008* (2013.01); *A63B 37/0022* (2013.01); *A63B 37/0031* (2013.01); *A63B 37/0033* (2013.01); *A63B 37/0047* (2013.01); *A63B 37/0063* (2013.01); *A63B 37/0064* (2013.01); *A63B 37/0065* (2013.01)

(58) Field of Classification Search

USPC ..... 473/373, 377

See application file for complete search history.

(56) References Cited

U.S. PATENT DOCUMENTS

| | | | | |
|---|---|---|---|---|
| 4,798,386 | A | 1/1989 | Berard | |
| 5,770,325 | A * | 6/1998 | Keller et al. | 428/187 |
| 5,935,022 | A * | 8/1999 | Sugimoto et al. | 473/373 |
| 6,022,279 | A * | 2/2000 | Yamagishi et al. | 473/353 |
| 6,435,984 | B1 | 8/2002 | Ohama | |

(Continued)

FOREIGN PATENT DOCUMENTS

| | | |
|---|---|---|
| EP | 0 561 640 A1 | 9/1993 |
| JP | 5-261166 A | 10/1993 |

(Continued)

OTHER PUBLICATIONS

Clariant, Feb. 23, 2012, Hostasol Yellow 3G Product Data Shet, 1 page.*

(Continued)

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

An object of the present invention is to provide a golf ball having a high performance as well as the visibility and the fashionable appearance. The present invention provides a colored golf ball having a color other than white and comprising: a core having a center and at least one intermediate layer disposed around the center, and a cover disposed around the core, wherein the cover and at least one of the intermediate layer preferably contain a fluorescent dye and/or a fluorescent pigment.

13 Claims, 9 Drawing Sheets

(56) References Cited

U.S. PATENT DOCUMENTS

| | | | | |
|---|---|---|---|---|
| 6,561,923 | B1 | 5/2003 | Ohama et al. | |
| 6,702,694 | B1 | 3/2004 | Watanabe | |
| 7,278,931 | B2 | 10/2007 | Manami et al. | |
| 7,648,428 | B2 | 1/2010 | Nagasawa | |
| 7,722,483 | B2 * | 5/2010 | Morgan et al. | 473/378 |
| 7,806,784 | B2 * | 10/2010 | Ohira | 473/378 |
| 2003/0120020 | A1 | 6/2003 | Yokota et al. | |
| 2004/0097302 | A1 * | 5/2004 | Isogawa et al. | 473/378 |
| 2004/0142770 | A1 | 7/2004 | Watanabe | |
| 2004/0162159 | A1 | 8/2004 | Kawamatsu | |
| 2004/0176188 | A1 | 9/2004 | Morgan et al. | |
| 2004/0266554 | A1 * | 12/2004 | Park et al. | 473/353 |
| 2005/0272900 | A1 * | 12/2005 | Kuntimaddi et al. | 528/44 |
| 2006/0003853 | A1 | 1/2006 | Yokota et al. | |
| 2006/0025242 | A1 | 2/2006 | Yokota et al. | |
| 2006/0166764 | A1 | 7/2006 | Kawamatsu | |
| 2006/0240911 | A1 * | 10/2006 | Higuchi et al. | 473/371 |
| 2007/0015602 | A1 | 1/2007 | Watanabe | |
| 2007/0135234 | A1 | 6/2007 | Nagasawa | |
| 2007/0149323 | A1 * | 6/2007 | Morgan et al. | 473/378 |
| 2008/0015053 | A1 | 1/2008 | Watanabe | |
| 2008/0032822 | A1 * | 2/2008 | Melanson et al. | 473/378 |
| 2008/0076603 | A1 * | 3/2008 | Shindo et al. | 473/367 |
| 2008/0132359 | A1 | 6/2008 | Rajagopalan et al. | |
| 2008/0182683 | A1 * | 7/2008 | Hirau et al. | 473/377 |
| 2008/0188326 | A1 * | 8/2008 | Wu et al. | 473/377 |
| 2008/0248898 | A1 | 10/2008 | Morgan et al. | |
| 2009/0036235 | A1 | 2/2009 | Watanabe et al. | |
| 2009/0054176 | A1 | 2/2009 | Isogawa et al. | |
| 2009/0091058 | A1 | 4/2009 | Yokota et al. | |
| 2009/0091060 | A1 | 4/2009 | Yokota et al. | |
| 2009/0137343 | A1 | 5/2009 | Morgan et al. | |
| 2010/0227710 | A1 * | 9/2010 | Morgan et al. | 473/374 |
| 2010/0240469 | A1 * | 9/2010 | Rajagopalan et al. | 473/374 |
| 2010/0261550 | A1 * | 10/2010 | Nagasawa et al. | 473/353 |

FOREIGN PATENT DOCUMENTS

| | | | |
|---|---|---|---|
| JP | 6-170013 | A | 6/1994 |
| JP | 2000-24139 | A | 1/2000 |
| JP | 2000-254250 | A | 9/2000 |
| JP | 2003-154034 | A | 5/2003 |
| JP | 2004-33594 | A | 2/2004 |
| JP | 2004-81670 | A | 3/2004 |
| JP | 2004-97802 | A | 4/2004 |
| JP | 2006-15059 | A | 1/2006 |
| JP | 2006-34691 | A | 2/2006 |
| JP | 2007-21205 | A | 2/2007 |
| JP | 2007-144097 | A | 6/2007 |
| JP | 2007-160087 | A | 6/2007 |
| JP | 2007-319432 | A | 12/2007 |
| JP | 2008-93423 | A | 4/2008 |
| JP | 2008-136872 | A | 6/2008 |
| JP | 2008-161375 | A | 7/2008 |
| JP | 2008-183148 | A | 8/2008 |
| JP | 2009-45347 | A | 3/2009 |

OTHER PUBLICATIONS

Clariant, Feb. 23, 2012, Hostasol Yellow 3G Product Data Sheet, 1 page.

English Translation of Japanese Office Action dated Dec. 18, 2012 for Application No. 2010-101371.

English Translation of Japanese Office Action dated Dec. 18, 2012 for Application No. 2010-101372.

English translation of the Japanese Office Action for Japanese Application No. 2010-101371 dated Sep. 17, 2013.

English translation of the Japanese Office Action for Japanese Application No. 2010-101372 dated Sep. 17, 2013.

Dupont, Hardness Conversion, uploaded Jun. 12, 2014, Dupont, 1 page.

Jeff Dalton, Compression by Any Other Name, uploaded Jun. 12, 2014, Science and Golf IV, 9 pages.

Northwest Florida State College, Absolute Density of Water, uploaded Jun. 12, 2014, Northwest Florida State College, 1 page.

Office Action dated Jun. 25, 2014 for parent U.S. Appl. No. 12/721,220.

* cited by examiner

COLORED GOLF BALL

CROSS-REFERENCE TO RELATED APPLICATION

This application is a Divisional of co-pending application Ser. No. 12/721,220 filed on Mar. 10, 2010. The entire contents of this application is hereby incorporated by reference.

FIELD OF THE INVENTION

The present invention relates to a colored golf ball.

DESCRIPTION OF THE RELATED ART

Conventionally, golf balls have a white color. In the case of bad weather conditions such as rainy, cloudy, foggy and dim conditions, it is difficult to follow the trajectory of the white colored golf ball and find where the golf ball stops. It is also difficult to find the white colored golf ball when the white colored golf ball stops on the dead grass.

Recently, the fashionable golf balls are required with an increase in the population of golf players. Under these circumstances, colored golf balls have been proposed to satisfy the requirements of the visibility and the fashionable appearance.

U.S. Pat. No. 6,561,923 (corresponding to JP 2000-24139 A) discloses a colored golf ball comprising a core having at least one layer and a cover having at least one layer formed on the core, wherein the outermost layer of the cover contains 3.0 to 7.0 parts by weight of at least one fluorescent pigment and 0.05 to 0.5 parts by weight of titanium dioxide, and the cover is coated with at least one layer of clear coating, said fluorescent pigment being an orangish fluorescent pigment, and the surface of the golf ball has a chromaticity value shown by an a*-value of 40 to 70 and a chromaticity value shown by a b*-value of 70 to 90, measured using a color difference meter, wherein the surface of the golf ball has an L*-value of 50 to 80, measured using a color difference meter.

U.S. Pat. No. 6,435,984 (corresponding to JP2000-254250 A) discloses a golf comprising: a golf ball body and a colored layer formed on the ball body, the colored layer containing a white inorganic pigment and/or a white organic pigment, a coloring inorganic pigment and/or a coloring organic pigment, and a fluorescent pigment, wherein values of L, a and b satisfy the following relationships when the color tone of the golf ball is represented by the Lab system.

$$L \geq 82,\ 10 \leq (a^2+b^2)^{1/2} \leq 45$$

JP2004-33594 A discloses a golf ball colored into anyone of blue, pink, or yellow, wherein L value, a value, and b value satisfy the following relationships when the color tone is represented by the Lab system.

$$35 \leq L-(a^2+b^2)^{1/2} \leq 55$$

JP2007-144097 A discloses a golf ball having a cover as the outermost surface, the cover satisfy brightness L* value being 50 or more, hue a* being −20 or less, or 20 or more, and hue b* being +35 or more when the color tone of the cover surface is evaluated by CIE/L*a*b* color coordinate system.

U.S. Pat. Publication No. 2007/0135234 A1 (corresponding to JP2007-160087 A) discloses a golf ball comprising a core and a cover of one or more layer that encloses the core, which cover has an outermost layer on which a plurality of dimples are formed, the ball being characterized in that the outermost layer is made of one or more thermoplastic or thermoset resin as a base material and includes therein one or more light collecting fluorescent dye, and in that at least 80% of the dimples formed on the outermost layer have a dimple edge angle of 5 to 30°.

JP2007-319432 A, JP2008-161375 A, and U.S. Pat. Publication No. 2008/0182683 A1 (corresponding to JP2008-183148 A) disclose a golf ball having a golf ball body and a paint film covering the golf ball body, wherein the golf ball body and/or the paint film contains a luster material.

JP2008-93423 A discloses a golf ball comprising a core, an intermediate layer covering the core, and a cover covering the intermediate layer as an outermost layer, wherein the intermediate layer contains (a) a thermoplastic resin, (b) a three-dimensional metal oxide having at least three needle-shaped parts, and (c) non-fluorescent pigment, wherein the cover contains the thermoplastic resin containing a liquid crystal polymer as an essential component, a sphere consisting of a core and an intermediate layer covering the core has L value of 60 to 85, a value of −25 to 25, b value of −25 to 25, and the golf ball body covered with the cover has L value of 50 to 80, when evaluated by Lab system.

U.S. Pat. Publication No. 2009/0054176 A1 (corresponding to JP2009-45347 A) discloses a golf ball which comprises a spherical main body having a core and a cover provided to cover the core, and a paint layer provided to cover the main body, the cover not including titanium oxide but including a fluorescent colorant, the main body having a chroma saturation of equal to or greater than 25, and the paint layer including a polarizing material.

U.S. Pat. No. 4,798,386 discloses a golf ball comprising a core and a fluorescent cover, said cover having a fluorescent material admixed therein, said fluorescent material being selected from the group consisting of 2.0 to 6.0% by weight of the cover of fluorescent pigments and 0.04 to 0.4% by weight of the cover of fluorescent dyes, the outermost surface of said golf ball having a transparent coat on the outer surface of said fluorescent cover, said golf ball having greater appearance durability than it would otherwise have in the absence of said fluorescent material, and higher gloss than it would otherwise have without said transparent coating.

U.S. Pat. Publication No. 2004/0176188 A1 discloses a golf ball comprising a core, a cover and at least on intermediate layer; wherein the intermediate layer is comprised of pigment which contributes to the color of the ball; and wherein the cover is at least partially transparent and is comprised of an optical enhancer.

U.S. Pat. No. 2009/0137343 A1 discloses a golf ball comprising a core and a cover and an optional intermediate layer disposed between the core and cover, wherein the core is opaque, and wherein the cover comprises a translucent material and an amount of pigment or dye, such that the L* value of the cover is either greater than about 80 when the color of the cover is not blue, green, yellow, pink, or orange, or less than about 80 when the color of the cover is blue, green, yellow, pink, orange, lilac, purple, indigo, violet, or any Pantone Matching System color.

SUMMARY OF THE INVENTION

As described above, colored golf balls have been proposed in order to give the visibility and the fashionable appearance. However, conventional colored golf balls do not necessarily provide high-performance with respect to the flight distance, abrasion resistance and controllability. The present invention has been achieved in view of the above circumstances. An object of the present invention is to provide a golf ball having a high performance as well as the visibility and the fashionable appearance.

The present invention is directed to a colored golf ball having a color other than white and comprising: a core having a center and at least one intermediate layer disposed around the center, and a cover disposed around the core, wherein the cover and at least one of the intermediate layer preferably contain a fluorescent dye and/or a fluorescent pigment.

In one preferable embodiment, the present invention includes a colored golf ball having a color other than white and comprising: a core having a center and at least one intermediate layer disposed around the center, and a cover disposed around the core, wherein at least one of the intermediate layer contains a fluorescent dye and/or a fluorescent pigment and a mass adjusting agent; and the cover contains a fluorescent dye and/or a fluorescent pigment. In this embodiment, since the intermediate layer and the cover contain the fluorescent dye and/or the fluorescent pigment, the resultant golf ball develops a deep and vivid color tone. Further, the intermediate layer contains a mass adjusting agent. Use of the mass adjusting agent increase a density of the intermediate layer and enhance the inertia moment of the golf ball. As a result, the golf balls provide low spin on a driver shot, and thus give a great distance and direction stability.

In another preferable embodiment, the present invention includes a colored golf ball having a color other than white and comprising: a core having a center and at least one intermediate layer disposed around the center, a cover disposed around the core, and at least one paint layer formed on the cover, wherein the cover and at least one of the intermediate layer contain a fluorescent dye and/or a fluorescent pigment in an amount of 0.5 part or more and 3 parts or less, and titanium oxide in an amount of 0.001 part or more and less than 0.5 part with respect to 100 parts by mass of a resin component, respectively. Adjusting the amounts of the fluorescent material and the titanium oxide in a specific range provides golf balls having a deep and vivid color tone.

In yet another preferable embodiment, the present invention includes a colored golf ball having a color other than white and comprising: a core having a center and at least one intermediate layer disposed around the center, a cover formed around the core, and a paint layer formed on the cover, wherein at least one of color differences ($\Delta E^*$) between the intermediate layer and the cover, between the intermediate layer and the paint layer, and between the cover and the paint layer is 12 or less in CIELAB color coordinate system. If the above color difference falls within the above range, the parting line does not become perceptive, and thus the golf ball has a good appearance.

DESCRIPTION OF THE PREFERRED EMBODIMENT

Figure 1:
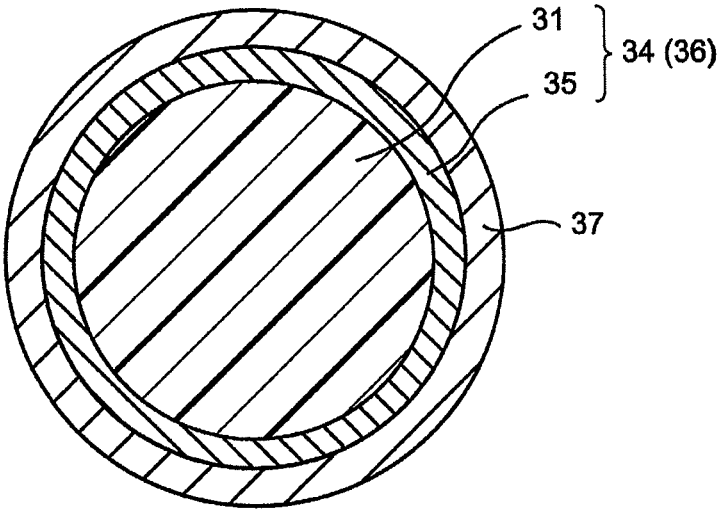
FIG. 1 is a cross sectional view schematically showing a preferable golf ball construction of the present invention.

The present invention is directed to a colored golf ball having a color other than white and comprising: a core having a center and at least one intermediate layer disposed around the center, and a cover disposed around the core, wherein the cover and at least one of the intermediate layer preferably contain a fluorescent dye and/or a fluorescent pigment.

Color of the Colored Golf Ball

The color of the colored golf ball of the present invention is not limited, as long as it is not white. Non-limiting examples of the color are red, orange, yellow, yellowgreen, green, cyan, blue, purple, and pink. In one preferable embodiment, the colored golf ball of the present invention has a color which satisfies the following equations in terms of L*, a*, and b* values on CIELAB color coordinate system.

$$L^*<85,\ a^*<-20 \text{ or } a^*>30,\ b^*>10$$

The golf ball having the color which satisfies the above equations provides a good visibility and fashionable appearance.

L*, a* and b* on CIELAB color coordinate system can be measured according to JIS-Z-8701 or WS-Z-8728. In the measurement, typically used is a color difference meter named "CR-221" manufactured by MINOLTA CO. in which a tristimulus values direct measuring method is adopted. Tristimulus values X, Y and Z are converted into L*, a*, and b* as follows.

$$L^*=116(Y/YN)^{1/3}-16$$

$$a^*=500[(X/XN)^{1/3}-(Y/YN)^{1/3}]$$

$$b^*=200[(Y/YN)^{1/3}-(Z/ZN)^{1/3}]$$

where XN, YN and ZN are tristimulus values in the XYZ coordinate system of a perfect diffuse reflection surface.

The "L*" value is an index of brightness. A larger "L" value indicates a brighter color. The L* value is preferably less than 85, more preferably 83 or less, even more preferably 82 or less. The lower limit of the L* value is not limited, but is preferably 50, more preferably 52, even more preferably 53.

The a* and b* values are indexes of hue. The color varies toward red as the "a" value is increasing, while on the other hand the color varies toward green as the "a" value is decreasing. The color varies toward yellow as the "b" value is increasing, while on the other hand the color varies toward blue as the "b" value is decreasing. The a* value is preferably less than −20, more preferably −23 or less, even more preferably −25 or less and is preferable −42 or more, more preferably −40 or more. Alternatively, the a* value is preferably more than 30, more preferably 33 or more, even more preferably 35 or more and is preferably 70 or less, more preferably 65 or less. In the case that the a* is less than −20, the color of the golf ball has a greenish or yellowgreenish color, while in the case that a* is more than 30, the golf ball has a reddish, orangish, or pinkish color. In the case that the golf ball has a pinkish color, the b value is preferable more than 10, more preferably 12 or more, and is preferably 30 or less, more preferably 27 or less. Further, in the case that the golf ball has a yellowish, yellowgreenish or orangish color, the b* value is preferably more than 30, more preferably 35 or more, even more preferably 37 or more, and is preferably 65 or less, more preferably 60 or less.

Further, the value $(a^{*2}+b^{*2})^{1/2}$ is an index of vividness. In one preferable embodiment, the value $(a^{*2}+b^{*2})$ preferably ranges from 45 to 75, more preferably 47 to 73. If it is too small, the color appears to be weak, and hence the ball becomes less perceptible in a cloudy, rainy or snowy weather. On the other hand, if it is too high, the color of the ball becomes too strong, giving a heavier impression to the golfer.

In one preferable embodiment, at least one of color differences (ΔE*) between the intermediate layer and the cover, between the intermediate layer and the paint layer, and between the cover and the paint layer is 12 or less in CIELAB color coordinate system. More preferably, both of the color difference (ΔE*) between the intermediate layer and the cover and the color difference (ΔE*) between the intermediate layer and the paint layer are 12 or less in CIELAB color coordinate system. Even more preferably, all of the above color differences (ΔE*) are preferably 12 or less in CIE LAB color coordinate system. Smaller color difference provides golf ball with a good appearance. The above color differences (ΔE*) are preferably 11 or less, more preferably 10 or less, even more preferably 9.5 or less, yet even more preferably 9 or less. The color difference is determined by the following equation. The lower limit of the color difference (ΔE*) is not limited, and is preferable as small as possible.

$$\Delta E^* = [(\Delta L^*)^2 + (\Delta a^*)^2 + (\Delta b^*)^2]^{1/2}$$

In the case of molding the cover in a compression molding method with half shells, a parting line or a seam is formed along the equator of the golf ball, and there is a case that the intermediate layer composition is seeping out from the parting line or the seam. Although the parting line or the seam is not perceived in most cases, if the color difference between the intermediate layer and the cover or between the intermediate layer and the paint layer is large, the parting line or the seam becomes conspicuous. Thus, the appearance of the final golf ball may deteriorate.

Materials for the Colored Golf Ball

In the followings, the materials for the colored golf ball of the present invention will be described.

Fluorescent Dye and/or Fluorescent Pigment

First, the fluorescent dye and/or fluorescent pigment useful in the present invention will be explained. The fluorescent dye may be organic or inorganic, and include any commercially available fluorescent dye. Suitable fluorescent dye includes, for example, thioxanthene derivative, xanthene derivative, perylene derivative, perylene imide derivative, coumarin derivative, thioindigoid derivative, naphthalimide derivative and methine derivative.

In one preferable embodiment, the fluorescent dye and/or the fluorescent pigment preferably has a melting point of 180° C. or less, more preferably 175° C. or less, even more preferably 170° C. or less, and preferably has a melting point of at least 135° C., more preferably 140° C. or more, even more preferably 145° C. or more. If the melting point of the fluorescent dye and/or pigment falls within the above range, mixing and dispersing the fluorescent dye and/or pigment in the resin component can be conducted in a relatively low temperature. Since color change due to the high temperature during processing is not likely to occur, the desired color can be obtained easily.

Specific examples of the fluorescent dyes are, but not limited to, yellow fluorescent dyes such as Lumogen F Orange™ 240 (BASF); Lumogen F Yellow™ 083 (BASF); Hostasol Yellow™ 3G (Hoechst-Celanese); Oraset Yellow™ 8GF (Ciba-Geigy); Fluorol 088™ (BASF); Thermoplast F Yellow™ 084 (BASF); Golden Yellow™ D-304 (DayGlo); Mohawk Yellow™ D-299 (DayGlo); Potomac Yellow™ D-838 (DayGlo) and Polyfast Brilliant Red™ SB (Keystone).

The fluorescent pigment includes, for example, a pigment where the fluorescent dye is dispersed into the polymeric material or a pigment where the fluorescent dye is formed into shape of particles. Examples of specific fluorescent pigments are, but not limited to, ZQ-11, ZQ-12, ZQ-13, ZQ-15, ZQ-16, ZQ-17-N, ZQ-18, ZQ-19, ZQ-21, GPL-11, GPL-13, GPX-14, GPL-15, GPX-17, and GPL-21 available from DayGlo Color Corporation; and FZ-2000 series, FZ-5000 series, FZ-6000 series, FZ-3040 series available from SINLOIHI Co., Ltd.

In a preferable embodiment, the cover and at least one of the intermediate layer preferably contain the fluorescent dye and/or the fluorescent pigment in an amount of 0.5 part or more, more preferably 0.6 part or more, even more preferably 0.7 part or more and preferably contain the fluorescent dye and/or the fluorescent pigment in an amount of 10 parts or less, more preferably 9 parts or less, even more preferably 8 parts or less, yet even more preferably 5 parts or less, yet even more preferably 3 parts or less with respect to 100 parts by mass of the resin component. If the amount is too large, the color of the golf ball becomes too deep and thus, the golf ball has a dark color tone, while if the amount is too small, the desired color is not obtained.

Ultraviolet Absorber, Light Stabilizer

Since the fluorescent dye and/or the fluorescent pigment has low light stability, it is preferable to use an ultraviolet absorber or light stabilizer. The ultraviolet absorber or the light stabilizer useful in the present invention is not limited, and includes any commercial product. Illustrative examples include ultraviolet absorbers such as salicylic acid derivatives, benzophenone derivatives, benzotriazole derivatives, cyanoacrylate derivatives, triazine derivatives, nickel complexes and light stabilizer such as hindered amine derivatives.

Examples of the salicylic acid derivative include phenyl salicylate, p-t-butylphenyl salicylate, p-octylphenyl salicylate and the like. Examples of the benzophenone derivative include 2,4-dihydroxybenzophenone, 2-hydroxy-4-methoxybenzophenone, 2-hydroxy-4-octoxybenzophenone, 2,2-dihydroxy-4,4'-methoxybenzophenone and the like. Examples of the benzotriazole derivative include 2-(2'-hydroxy-5'-methylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole, 2-[2-hydroxy-3,5-bis(α,α'-dimethylbenzyl)phenyl]-2H-benzotriazole, 2-(5-methyl-2-hydroxyphenyl)benzotriazole. Examples of the cyanoacrylate derivative include 2-ethylhexyl-2-cyano-3,3'-diphenyl acrylate, ethyl-2-cyano-3,3'-diphenyl acrylate. Examples of the triazine derivative include 2-(4,6-diphenyl- 1,3,5-triazine-2-yl)-5[(hexyl)oxy]-phenol, 2,4-bis(2-hydroxy-4-butyroxyphenyl]-6-(2,4-bis-butyroxyphenyl)-1,3,5-triazine and 2-[4-[(2-hydroxy-3-(2'-ethyl)hexyl)oxy]-2-hydroxyphenyl]-4,6-bis(2,4-dimethylphenyl)-1,3,5-triazine. Specifically, the benzophenone based ultraviolet absorber includes "Sumisoap 130," "Sumisoap 140" or the like manufactured by Sumitomo Chemical Co., Ltd.; the benzotriazole based ultraviolet absorber includes "TINUVIN 234", "TINUVIN 900", "TINUVIN 326", "TINUVIN P" or the like manufactured by Ciba Specialty Chemicals plc.; and the cyanoacrylate based ultraviolet absorber includes "Uvinul N-35" or the like manufactured by BASF Corporation. The triazine based ultraviolet absorber includes "TINUVIN 1577", "TINUVIN 460", "TINUVIN 405" or the like manufactured by Ciba Specialty Chemicals plc. These ultraviolet absorbers may be used individually or in combination of two or more. The ultraviolet absorbers that can be used in the present invention are not limited to the above examples, and any ultraviolet absorber that is publicly known can be used in the present invention.

Examples of the hindered amine light stabilizer include bis(1,2,2,6,6-pentamethyl-4-piperidyl)[[3,5-bis(1,1-dimethylethyl)-4-hydroxyphenyl]methyl]butylmalonate], and 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine. Specific examples include trade name "Sanol LS-2626" and trade name "TINUVIN 144" manufactured by Ciba Specialty Chemicals plc.

The amount of the ultraviolet absorber is preferably 0.02 part or more, more preferably 0.04 part or more, and is preferably 2 parts or less, more preferably 1 part or less, with respect to 100 parts by mass of the resin component in the intermediate layer, the cover or the paint layer. If the amount of the ultraviolet absorber falls within the above range, the color change due to the exposure to the sunlight is effectively suppressed.

Center Composition

As the center of the golf ball of the present invention, a conventionally known rubber composition (hereinafter sometimes simply referred to as "center rubber composition") may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a polyisoprene rubber, a styrene polybutadiene rubber, and ethylene-propylene-diene terpolymer (EPDM) may be used. Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.1 part by mass or more, more preferably 0.3 part by mass or more, even more preferably 0.5 part by mass or more and is preferably 3 parts by mass or less, more preferably 2.8 parts by mass or less, even more preferably 2.5 parts by mass or less based on 100 parts by mass of the base rubber. If the amount is less than 0.1 part by mass, the center becomes too soft, and the resilience tends to be lowered, and if the amount is more than 3 parts by mass, the amount of the co-crosslinking agent must be increased in order to obtain the appropriate hardness, and thus the repulsion is likely to be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 15 parts or more, even more preferably 20 parts or more, and is preferably 55 parts or less, more preferably 50 parts or less, even more preferably 48 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the center becomes too hard, so that the shot feeling may be lowered.

The filler contained in the center rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 0.5 parts or more, more preferably 1 part or more, and is preferably 30 parts or less, more preferably 20 parts or less based on 100 parts of the base rubber by mass. If the amount of the filler to be blended is less than 0.5 parts by mass, it becomes difficult to adjust the weight, while if it is more than 30 parts by mass, the weight ratio of the rubber component becomes small and the resilience tends to be lowered.

As the center rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide; a mono-substituted diphenyl disulfide such as bis(4-chlorophenyl) disulfide, bis(3-chlorophenyl) disulfide, bis(4-bromophenyl) disulfide, bis(3-bromophenyl) disulfide, bis(4-fluorophenyl) disulfide, bis(4-iodophenyl) disulfide and bis(4-cyanophenyl) disulfide; a di-substituted diphenyl disulfide such as bis(2,5-dichlorophenyl) disulfide, bis(3,5-dichlorophenyl) disulfide, bis(2,6-dichlorophenyl) disulfide, bis(2,5-dibromophenyl) disulfide, bis(3,5-dibromophenyl) disulfide, bis(2-chloro-5-bromophenyl) disulfide, and bis(2-cyano-5-bromophenyl) disulfide; a tri-substituted diphenyl disulfide such as bis(2,4,6-trichlorophenyl) disulfide, and bis(2-cyano-4-chloro-6-bromophenyl) disulfide; a tetra-substituted diphenyl disulfide such as bis(2,3,5,6-tetra chlorophenyl) disulfide; a penta-substituted diphenyl disulfide such as bis(2,3,4,5,6-pentachlorophenyl) disulfide and bis(2,3,4,5,6-pentabromophenyl) disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and is preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

Intermediate Layer Composition

The intermediate layer composition for forming the intermediate layer includes, for example, a rubber composition exemplified for the center and a resin composition containing a resin component. The intermediate layer composition is preferably a resin composition. That is, the content of the resin component in the intermediate layer composition is 50 mass % or more. Non-limiting examples of the resin component are an ionomer resin having a trade name "Himilan (registered trademark) (e.g. "Himilan 1605", "Himilan 1706" and "Himilan AM7329")" available from Du Pont-Mitsui Polychemicals Co., Ltd., an ionomer resin having a trade name "Surlyn (registered trademark) (e.g. "Surlyn 8140", "Surlyn 9120" and "Surlyn 8945")" available from E.I. du Pont de Nemours and Company, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A") available from BASF Japan Ltd, a thermoplastic polystyrene elastomer having a trade name "Rabalon (registered trademark) (e.g. "Rabalon T3221C")" commercially available from Mitsubishi Chemical Corporation, and the like. These resins and elastomers may be used solely or in combination of two or more types thereof. Among them, in view of the repulsion, the intermediate layer composition preferably comprises a mixture of the ionomer resin as the resin component.

Surrounding Layer Composition

As described later, the intermediate layer includes a surrounding layer which directly cover the center in an inner core. Examples of the resin component of the surrounding layer composition for forming the surrounding layer include, in addition to the rubber composition like the center rubber composition, thermoplastic resins such as an ionomer resin having a trade name "Himilan (registered trademark) (e.g. "Himilan 1605" and "Himilan 1706") available from Du Pont-Mitsui Polychemicals Co., Ltd., an ionomer resin having a trade name "Surlyn (registered trademark) (e.g. "Surlyn 8140" and Surlyn "9120") available from E.I. du Pont de Nemours and Company, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A") available from BASF Japan Ltd, a thermoplastic polystyrene elastomer having a trade name "Rabalon (registered trademark)" commercially available from Mitsubishi Chemical Corporation, and the like. These thermoplastic resins and thermoplastic elastomers may be used solely or in combination of two or more types thereof. Among them, since the relatively low hardness and the high rebound property are required for the surrounding layer, the rubber composition like the center rubber composition is preferably used.

In one preferable embodiment, the intermediate layer contains a mass adjusting agent. Use of the mass adjusting agent increase a density of the intermediate layer and enhance the inertia moment of the golf ball. As a result, the golf balls provide low spin on a driver shot, and thus give a great distance and direction stability. Suitable examples of the mass adjusting agent are, but not limited to, inorganic fillers such as zinc oxide, barium sulfate, titanium oxide, calcium carbonate, magnesium oxide, tungsten powder, and molybdenum powder. The mass adjusting agent may be used alone or in combination of at least two of them.

The amount of the mass adjusting agent contained in the intermediate layer may be determined depending on the desired density, but is preferably 1 part or more, more preferably 2 parts or more, even more preferably 3 parts or more, and is preferably 50 parts or less, more preferably 47 parts or less, even more preferably 44 parts or less based on 100 parts of the resin component by mass. If the amount of the mass adjusting agent is 1 part or more by mass, it becomes easy to adjust the density of the intermediate layer, while if the amount is 50 parts or less by mass, the dispersibility of the mass adjusting agent into the resin component becomes good.

The intermediate layer preferably has a density of 0.80 $g/cm^3$ or more, more preferably 0.85 $g/cm^3$ or more, even more preferably 0.90 $g/cm^3$ or more, yet even more preferably 0.95 $g/cm^3$ or more, yet even more preferably 1.00 $g/cm^3$ or more. If the intermediate layer has a higher density, the resultant golf ball has a high inertia moment and thus provides a low spin on the driver shot. Therefore, the great distance and high direction stability is obtained. The intermediate layer has no limitation on the upper limit of the density, but preferably has a density of 1.50 $g/cm^3$ or less, more preferably 1.40 $g/cm^3$ or less, even more preferably 1.30 $g/cm^3$ or less, even more preferably 1.20 $g/cm^3$ or less.

In one preferable embodiment, the intermediate layer is preferably transparent or translucent. If the cover is also transparent or translucent, the resultant golf ball has a unique appearance and a high performance. Herein, "translucent" means that if the logos or marks are formed on the underlying layer of the intermediate layer, the logos or marks are perceptive or visible through the intermediate layer. The clear visibility may not be necessary, but vague visibility may be acceptable. On the other hand, "transparent" means that the logos or marks are clearly visible through the intermediate layer.

In the case that titanium oxide is used as the mass adjusting agent, since titanium oxide provides high opacity, the amount of the titanium oxide is preferably 0.001 part or more, more preferably 0.002 part or more, more preferably 0.005 part or more, and is preferably 1 part or less, more preferably 0.5 part or less, even more preferably 0.45 part or less, yet even more preferably 0.3 part or less. If the amount of the titanium oxide is less than 0.001 part, it is difficult to adjust the weight of the intermediate layer, while if the amount is 1 part or less, the resultant intermediate layer becomes transparent or translucent.

It is also preferable to use a low opaque mass adjusting agent that provides a translucent or transparent intermediate layer. If the low opaque mass adjusting agent is used, the transparent and translucent intermediate layer is obtained without lowering the density of the intermediate layer. Thus, the unique appearance and high performance is achieved. The amount of the low opaque mass adjusting agent is preferably 5 parts or more, more preferably 5.5 parts or more, even more preferably 6 parts or more, and is preferably 30 parts or less, more preferably 25 parts or less, even more preferably 20 parts or less. If the amount is 5 parts or more, it becomes easy to adjust the mass of the intermediate layer, while if the amount is 30 parts or less, the transparent or translucent intermediate layer is obtained. As the low opaque mass adjusting agent, barium sulfate or calcium carbonate is preferable.

The intermediate layer composition may further contain an antioxidant, a dispersant, an ultraviolet absorber, a light stabilizer, a fluorescent material or a fluorescent brightener, or the like as long as they do not impair the performance of the intermediate layer. Ultraviolet absorbers and light stabilizers exemplified above can be used for the intermediate layer.

Adhesion Promoting Layer Composition

The golf ball of the present invention may further comprise an adhesion promoting layer in order to enhance the adhesion between the intermediate layer and the cover. In the case that the adhesion between the intermediate layer and the cover is low, wrinkles may be formed on the surface of the cover when the golf ball is hit with the edge of the club.

The adhesion promoting layer is formed from an adhesion promoting layer composition. The adhesion promoting layer composition preferably comprises a two-component curing type resin. Examples of the two-component curing type resins are an epoxy resin, an urethane resin, an acrylic resin, a polyester resin and a cellulose resin. The two-component curing type resin preferably contains, for example, a base resin and a curing agent, and if necessary a solvent. When the two-component curing type resin is applied, the adhesion promoting layer is formed by a reaction between the base resin and the curing agent. In view of the adhesion and durability, two-component curing type epoxy resins or two-component curing type urethane resins are preferable. In the present invention, the adhesion promoting layer composition is preferably transparent or translucent.

Cover Composition

In the followings, the cover of the golf ball of the present invention will be described. Examples of the resin component of the cover composition for forming the cover include, an ionomer resin, a thermoplastic polyurethane elasotmer having a trade name "Elastollan (e.g. "Elastollan XNY85A, XNY83A, XNY 90A, XNY75A, and ET880") commercially available from BASF Japan Ltd, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polystyrene elastomer having a trade name "Rabalon (registered trademark)" commercially available from Mitsubishi Chemical Corporation, and the like.

Specific examples of the ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM7311 (Mg), Himilan AM7329 (Zn), and the like)" commercially available from Du Pont-Mitsui Polychemicals Co., Ltd. Further, ionomer resins commercially available from E.I. du Pont de Nemours and Company include trade name "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li), and the like)", "HPF 1000 (Mg)", and the like. Further, ionomer resins commercially available from ExxonMobil Chemical Corporation include trade name "Iotek (registered trademark) (e.g. Iotek 8000 (Na), Iotek 8030 (Na), Iotek 7010 (Zn), Iotek 7030 (Zn), and the like)".

It is noted that Na, Zn, Li, and Mg described in the parentheses after the trade names of the ionomer resins indicate metal types of neutralizing metal ions for these ionomer resins.

These resin components may be used solely or in combination of two or more types thereof. Among them, a polyurethane elastomer is preferable.

The cover composition for forming the cover of the golf ball of the present invention preferably contains a polyurethane resin as the resin component in an amount of 50 mass % or more, more preferably 60 mass % or more, and even more preferably 70 mass % or more. In a more preferable embodiment, the resin component in the cover composition consists of the polyurethane resin. If the resin component constituting the cover contains a thermosetting or thermoplastic polyurethane resin as a main component, the spin rate on the shots with the short iron is stabilized, and thus the controllability of the golf ball is improved.

The polyurethane resin is not particularly limited, as long as it has a plurality of urethane bonds within the molecule. For example, the polyurethane resin is a reaction product obtained by reacting a polyisocyanate component with a high-molecular-weight polyol component to have urethane bonds formed within the molecule. Further, a chain extension reaction with a low-molecular-weight polyol, a low-molecular-weight polyamine, or the like is performed if necessary.

The slab hardness in Shore D hardness of the polyurethane resin is preferably 20 or more, more preferably 22 or more, and even more preferably 24 or more, and is preferably 45 or less, more preferably 43 or less, and even more preferably 40 or less. If the hardness of the polyurethane resin is excessively low, the spin rate upon a shot with a driver may increase. Further, if the hardness of the polyurethane resin is excessively high, the spin rate upon a shot with an approach wedge may become excessively low. Specific examples of the polyurethane resin include Elastollan (registered trademark) XNY85A, XNY83A, XNY 90A, XNY75A, and ET880 manufactured by BASF Japan Ltd., and the like.

In one preferable embodiment, the cover is preferably transparent or translucent, but the cover may further include titanium oxide. The combination of a small amount of titanium oxide with the fluorescent dye and/or fluorescent pigment provides the translucent cover with the vivid color. Since titanium oxide provides high opacity, the amount of the titanium oxide is preferably 0.001 part or more, more preferably 0.002 part or more, more preferably 0.005 part or more, and is preferably less than 0.5 part, more preferably 0.45 part or less, even more preferably 0.3 part or less with respect to 100 parts by mass of the resin component. If the amount of titanium oxide is 0.001 part or more, the translucent cover with the vivid color is obtained, while if the amount of the titanium oxide is 0.5 part or more, the cover tends to be opaque.

In the present invention, in addition to the aforementioned resin component, the cover may contain a pigment component, a mass adjusting agent such as zinc oxide, calcium carbonate, barium sulfate, and the like, a dispersant, an antioxidant, an ultraviolet absorber, a light stabilizer, a fluorescent material or a fluorescent brightener, and the like as long as they do not impair the performance of the cover. Ultraviolet absorbers and light stabilizers exemplified above can be used for the cover.

Paint Composition

The golf ball of the present invention preferably comprises at least one paint layer on the golf ball body. The paint layer is preferably a clear paint layer.

The resin component constituting the paint layer is not particularly limited, and an acrylic resin, an epoxy resin, a polyurethane resin, a polyester-based resin, a cellulose-based resin and the like may be used, but a two-component curing type polyurethane resin described later is preferably used. If the two-component curing type polyurethane resin is used, a paint layer which is further excellent in durability can be obtained.

The two-component curing type polyurethane resin is a polyurethane resin obtained by reacting a base resin and a curing agent. Such examples include one obtained by curing a base resin containing a polyol component with a polyisocyanate compound or a derivative thereof.

The base resin containing the polyol component preferably contains a specific urethane polyol as described in the following. The urethane polyol is synthesized by a reaction between a polyisocyanate and a polyol. The polyisocyanate used for the synthesis is not particularly limited as long as it has two or more isocyanate groups. Such examples include an aromatic polyisocyanate such as 2,4-toluene diisocyanate, 2,6-tolylene diisocyanate, the mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODD, xylylene diisocyanate (XDI), tetramethylxylylene diisocyanate (TMXDI), and paraphenylene diisocyanate (PPDI); and an alicyclic or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), norbornene diisocyanate (NBDI). These may be used either alone or as a mixture of at least two of them. Among them, in view of weather resistance, a non-yellowing type polyisocyanate such as TMXDI, XDI, $HD_1$, $H_6$XDI, $IPD_1$, $H_{12}$MDI, and NBDI is preferably used. The polyisocyanate may be also used as a curing agent for curing the urethane polyol.

The polyol used for preparing the urethane polyol is not particularly limited as long as it has a plurality of hydroxyl groups. Such examples include a polyol having a low-molecular weight and a polyol having a high molecular weight. Examples of the polyol having a low-molecular weight include a diol such as ethylene glycol, diethylene glycol, triethylene glycol, 1,3-butanediol, 1,4-butanediol, neopentyl glycol, and 1,6-hexanediol; and a triol such as glycerin, trimethylol propane, and hexanetriol. Examples of the polyol having a high molecular weight include a polyether polyol such as polyoxyethylene glycol (PEG), polyoxypropylene glycol (PPG), polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol such as polyhexamethylene carbonate; an acrylic polyol and the like. Among the polyols described above, a polyol having a weight average molecular weight of 50 to 2,000, particularly a polyol having a weight average molecular weight of about 100 to 1,000 is preferably used. These polyols may be used either alone or as a mixture of at least two of them.

The urethane polyol is a polyol wherein a urethane bond is formed by a reaction between the polyisocyanate and a polyol, having a hydroxyl group at a terminal thereof. Herein, a ratio of the urethane bonds in the urethane polyol is preferably 0.1 mmol to 5 mmol in 1 g of the urethane polyol. A ratio of the urethane bonds is related to rigidity of the paint layer to be formed, and if it is less than 0.1 mmol/g, urethane concentration of the paint layer to be formed becomes so low that abrasion-resistance may become insufficient. On the other hand, if it is more than 5 mmol/g, the paint layer becomes so hard that the flexibility of the film with the deformation of the golf ball body is lowered and the paint layer is more susceptible to cracking.

A weight average molecular weight of the urethane polyol is preferably 4,000 or more, more preferably 4,500 or more, and preferably less than 10,000, more preferably 9,000 or less. If it is less than 4,000, it takes a long time to dry, so that workability and productivity becomes lowered. On the other hand, if the urethane polyol has a high molecular weight of 10,000 or more, the hydroxyl value of the urethane polyol becomes relatively small, so that an amount to be reacted after coating becomes small and thus adhesion to a base (golf ball body) tends to be lowered. Additionally, if a weight average molecular weight is 9,000 or less, a dense paint layer (or a clear paint layer) which is less in lowering of adhesion even in a state of being wet in water can be formed.

A hydroxyl group value of the urethane polyol is preferably 15 mgKOH/g or more, more preferably 25 mgKOH/g or more, and preferably 130 mgKOH/g or less, more preferably 120 mgKOH/g or less. If it is less than 15 mgKOH/g, a reaction with the curing agent becomes insufficient, so that adhesion strength with the ball body may become difficult to obtain. On the other hand, if it is more than 130 mg KOH/g, a reaction with the curing agent requires a long time so that a drying time becomes longer to lower the productivity and, at the same time, the ball becomes susceptible to cracking at the time of impact.

The urethane polyol as described above can be obtained by reacting a polyol and a polyisocyanate which are to be raw materials in such a proportion that the hydroxyl groups of the polyol component is in excess relative to the isocyanate groups of the polyisocyanate component by molar ratio. In the above described reaction, a solvent or a catalyst (e.g., dibutyl tin dilaurylate) publicly known for use in a urethane reaction may be used. A ratio of the urethane bond may be adjusted by adjusting a molecular weight of the polyol which is to be a raw material, a blending ratio of the polyol and the polyisocyanate and the like.

The polyol component constituting the base resin is preferably the specific urethane polyol itself; that is, preferably, the base resin is substantially the specific urethane polyol, but may include a polyol which is compatible with the urethane polyol and devoid of the urethane bond, in addition to the urethane polyol. In such a case, the polyol devoid of the urethane bond is not particularly limited, and the above-mentioned raw material polyol for synthesizing the urethane polyol may be used. If the base resin contains a polyol devoid of the urethane bond, a content of the urethane polyol in the base resin is preferably 50 mass % or more, more preferably 80 mass % or more. If the content of the urethane polyol in the base resin is less than 50 mass %, the content of the urethane polyol becomes relatively small, so that a drying time becomes longer.

Besides the abovementioned base resin, the paint layer may further contain an additive which is included in a paint for a conventional golf ball such as an ultraviolet absorber, an antioxidant, a light stabilizer, a fluorescent brightener, an antiblocking agent, and a pigment. The ultraviolet absorbers and light stabilizers exemplified above can be used for the paint composition.

Ink Composition

The golf ball of the present invention preferably has a mark. The mark is preferably formed by using an ink composition which is normally used for an ink composition for marking a golf ball, for example, one containing a pigment, a solvent, a base resin, other additives and the like. The base resin for the ink composition for marking is not particularly limited, and may include a polyester resin, an epoxy resin, nitrocellulose, an acrylic resin, a vinyl chloride-vinyl acetate copolymer, a polyurethane resin, and a polyamide resin. The epoxy resin, the polyester resin, the nitrocellulose or the like are preferred since they are excellent in adhesion. When the epoxy resin is used as the base resin, for example, it is preferred to use a polyisocyanate such as hexamethylene diisocyanate, isophorone diisocyanate, and tolylene diisocyanate as a curing agent. The solvent of the ink composition for marking is not particularly limited, and may include cyclohexanone, acetylacetone, propyleneglycol monomethylether acetate, methoxymethylbutylacetate, ethylacetate, and aromatic hydrocarbon, or a mixture solvent of at least two of them. The other additives may include a delustering agent, a defoamer and the like, and as a delustering agent, colloidal silica, a low density polyethylene particle, a medium density polyethylene particle and the like may be used.

In the present invention, the paint layer preferably comprises a luster material.

Examples of the luster material useful in the present invention include a luster material having a core layer covered with one or more layers of a light-reflective material, such as the luster material having a core layer consisting of mica, a pearl flake, a glass flake, a metal or a metal oxide, and a light-reflective material consisting of a metal, a metal oxide, or a metal nitride and covering the surrounding area of the core layer. Examples of the metal of the core layer include at least one kind selected from the group consisting of aluminum, chromium, cobalt, gold, silver, nickel, and iron. Examples of the metal oxide used for the core layer and the light-reflective material include titanium dioxide, iron oxide and the like.

Specific examples of the luster material include, for example, a luster material having a core layer consisting of mica and a metal oxide consisting of titanium oxide or iron oxide covering a surrounding of the core layer ("Iriodin" manufactured by Merck Ltd.), a luster material having a core layer consisting of a glass flake and a metal oxide consisting of titanium dioxide or iron oxide or a metal such as gold, silver, and nickel covering a surrounding of the core layer. ("Metashine" manufactured by Nippon Sheet Glass Co., Ltd.), and a luster material having a core layer consisting of aluminum or an iron oxide and a metal oxide consisting of silicon dioxide or iron oxide covering a surrounding of the core layer. ("Variocrom" manufactured by BASF).

In the present invention, a photochromic laminated body formed by laminating polymer layers having different refractive index, preferably a photochromic laminated body formed by laminating two kinds of polymer layers having different refractive indexes alternately may be used as the luster material. The photochromic laminated body is considered to exhibit the excellent luster due to the following mechanism. Namely, incident lights entering into the photochromic laminated body from the outside reflects at the surface of the laminated body and at the interface of the multi layer structure, and these reflected lights interfere with each other. Then, since polymers having different refractive indexes are laminated, a reflected light having a specific color is strengthened depending on a film thickness of the polymer layer and the number of laminated layers and the like, and thus the metallic luster having a subtly different colors are developed depending on an angle from which they are viewed. Specific examples of the photochromic laminated body include, for example, "Morphotone" manufactured by TEIJIN FIBERS LIMITED.

A content of the luster material in the paint layer is not particularly limited, but it is preferably 1 part by mass or more, more preferably 3 parts by mass or more, even more preferably 5 parts by mass or more and is preferably 20 parts by mass or less, more preferably 15 parts by mass or less, even more preferably 13 parts by mass or less based on 100 parts by mass of the resin component. There is a tendency that luster becomes insufficient if the content of the luster material is less than the lower limit, while if it is more than the upper limit, durability of the paint layer becomes lowered.

The paint composition is explained based on a solvent born system. However, the water born or aqueous paint can be also used in the present invention. The water born or aqueous paint is disclosed in U.S. Pat. Nos. 7,371,193 and 7,387,821 and U.S. Patent Publication No. 2005/082661 A1, which is incorporated in its entirety by reference herein.

Golf Ball Construction

The golf ball of the present invention comprises a core having a center and at least one intermediate layer disposed around the center, and a cover disposed around the core. Specific examples of the golf ball of the present invention include a three-piece golf ball comprising a core having a center and an intermediate layer covering the center, and a cover covering the core; a four-piece golf ball comprising a core having a center and two intermediate layers covering the center, and a cover covering the core; and a multi-piece golf ball comprising a core having a center and multi-piece of intermediate layers or multi-layer of intermediate layers covering the center, and a cover covering the core. In the present invention, the intermediate layer is defined as a layer disposed between the center and the outermost cover, but the intermediate layer of the present invention may be called a surrounding layer, inner core layer, outer core layer or inner cover layer in a different way to define the construction of the golf ball. Further, the sphere consisting of the center and an inner core layer may be called as an inner core.

Figure 2:
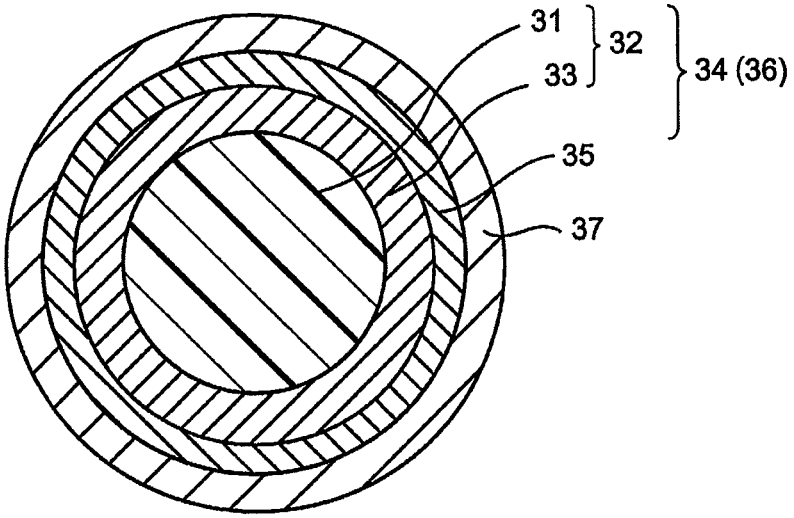
FIG. 2 is a cross sectional view schematically showing another preferable golf ball construction of the present invention.

FIG. 1 shows a preferable golf ball construction (hereinafter, sometimes may be referred to as "preferable construction A"). In a preferable golf ball construction A, the three-piece golf ball of the present invention comprises a core 34 having a center 31 and a single-layered intermediate layer 35 covering the center 31; and a cover 37 covering the core 34. FIG. 2 shows another preferable golf ball construction (hereinafter, sometimes may be referred to as "preferable construction B"). In a preferable golf ball construction B, the four-piece golf ball of the present invention comprises a core 34 having a center 31 and two intermediate layers 33, 35 covering the center 31, and a cover 37 covering the core 34. In this embodiment, the sphere consisting of the center 31 and the intermediate layer 33 may be called an inner core 32, the intermediate layer 33 covering the center may be called a surrounding layer, and the sphere consisting of the center 31 and two intermediate layers 33, 35 may be called an outer core 36 in a different way to define the golf ball construction, respectively.

In the preferable golf ball construction A, the core normally has a spherical shape, but the core preferably has dimples on the surface thereof at the positions corresponding to the dimples of the cover. As a result, the cover having a nearly uniform thickness at the dimple bottom portion and a land portion is obtained. On the other hand, the center generally has the spherical shape, but the center may be provided with a rib on the surface thereof so that the surface of the spherical center is divided by the ribs. For example, the surface of the spherical center is evenly divided by the ribs. In one preferable embodiment, the ribs are preferably formed on the surface of the spherical center in an integrated manner, and in another preferable embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

In a preferable construction A, the diameter of the center is preferably 38.0 mm or more and more preferably 38.5 mm or more, and is preferably 42.0 mm or less and more preferably 41.5 mm or less. If the diameter of the center is less than 38.0 mm, the thickness of the intermediate layer or the cover needs to be greater than a desired thickness, and hence the resilience may deteriorate. On the other hand, if the diameter of the center exceeds 42.0 mm, the thickness of the intermediate layer or the cover needs to be smaller than the desired thickness, and hence the intermediate layer or the cover may not function well.

When the center has a diameter in a range from 38.0 mm to 42.0 mm, a compression deformation amount of the center (an compression amount of the center in the compression direction thereof) when applying a load from an initial load of 98 N to a final load of 1275 N is preferably 2.0 mm or more and more preferably 2.2 mm or more, and is preferably 4.0 mm or less and more preferably 3.8 mm or less. If the compression deformation amount is less than 2.0 mm, the shot feeling may become hard and deteriorate. If the compression deformation amount exceeds 4.0 mm, the repulsion may deteriorate.

The surface hardness H2 in JIS-C hardness of the center is preferably 65 or more, more preferably 70 or more, and even more preferably 75 or more, and is preferably 105 or less, more preferably 100 or less, and even more preferably 95 or less. If the surface hardness H2 in JIS-C hardness of the center is less than 65, the golf ball becomes excessively soft and the resilience may deteriorate, thereby decreasing the flight distance. On the other hand, if the surface hardness H2 in JIS-C hardness of the center is more than 105, the golf ball becomes excessively hard and the shot feeling may deteriorate.

It is preferable that the center of the present invention has a larger surface hardness H2 than the center hardness H1. The hardness difference (H2–H1) between the surface hardness H2 and the center hardness H1 of the center in the preferable construction A is preferably 10 or larger, more preferably 11 or larger in JIS-C hardness. Making the surface hardness of the center larger than the center hardness increases the launch angle and reduces the spin rate, thereby improving the flight distance. The hardness difference (H2–H1) between the surface hardness H2 and the center hardness H1 of the center is, without limitation, preferably 35 or less, more preferably 30 or less in JIS-C hardness. If the hardness difference is too large, the durability of the golf ball tends to be lower.

The thickness of the intermediate layer is preferably 0.3 mm or more, more preferably 0.6 mm or more, and even more preferably 0.7 mm or more, and is preferably 2.0 mm or less, more preferably 1.8 mm or less, and even more preferably 1.5 mm or less. If the thickness of the intermediate layer is 0.3 mm or more, since the intermediate layer does not become excessively thin, the durability of the golf ball becomes better. If the thickness of the intermediate layer is 2.0 mm or less, the resilience of the golf ball becomes better to give a greater flight distance. Further, the shot feeling becomes better.

The diameter of the core of the golf ball in a preferable construction A is preferably 40.8 mm or more, more preferably 40.9 mm or more, and even more preferably 41 mm or more. If the diameter of the core is less than 40.8 mm, the cover becomes excessively thick and thus the repulsion may deteriorate. Further, the diameter of the core is preferably 42.6 mm or less, more preferably 42.5 mm or less, and even more preferably 42.4 mm or less. If the diameter of the core is more than 42.6 mm, the cover becomes relatively thin and a protection effect of the cover is not sufficiently obtained.

When the core has a diameter in a range from 40.8 mm to 42.6 mm, a compression deformation amount of the core (an compression amount of the core in the compression direction thereof) when applying a load from an initial load of 98 N to a final load of 1275 N is preferably 2.0 mm or more and more preferably 2.2 mm or more, and is preferably 3.5 mm or less and more preferably 3.3 mm or less. If the compression deformation amount is less than 2.0 mm, the shot feeling may become hard and deteriorate. If the compression deformation amount exceeds 3.5 mm, the resilience may deteriorate.

It is preferable that the core of the present invention has a larger surface hardness H6 than the center hardness H1. The hardness difference (H6–H1) between the surface hardness H6 and the center hardness H1 of the core in the preferable construction A is preferably 20 or larger, more preferably 21 or larger in JIS-C hardness. Making the surface hardness of the core larger than the center hardness increases the launch angle and reduces the spin rate, thereby improving the flight distance. The hardness difference (H6–H1) between the surface hardness H6 and the center hardness H1 of the core is, without limitation, preferably 40 or less, more preferably 39 or less in JIS-C hardness. If the hardness difference is too large, the durability of the golf ball tends to be lower.

The center hardness H1 of the core (center) is preferably 50 or larger, more preferably 53 or larger, and even more preferably 55 or larger in JIS-C hardness. If the center hardness H1 is 50 or larger in JIS-C hardness, the core (center) does not become too soft, resulting in the good resilience. The center hardness H1 of the core (center) is preferably 85 or smaller, more preferably 82 or smaller, and even more preferably 80 or smaller in JIS-C hardness. If the center hardness H1 is 85 or less in JIS-C hardness, the core (center) does not become too hard, resulting in the good shot feeling. In the present invention, the center hardness H1 of the core (center) is the hardness measured with the JIS-C type spring hardness tester at the central point of a cut plane of a core (center) which has been cut into two halves.

The surface hardness H6 of the core is preferably 80 or larger, more preferably 83 or larger, and even more preferably 85 or larger in JIS-C hardness. If the surface hardness H6 is 80 or larger, the core does not become too soft, and the good repulsion would be obtained. The surface hardness H6 of the core is preferably 105 or smaller, more preferably 102 or smaller, and even more preferably 100 or smaller in JIS-C hardness. If the surface hardness H6 is 105 or smaller in JIS-C hardness, the core does not become too hard, and the good shot feeling would be obtained.

The slab hardness H7 in Shore D hardness of the cover composition is preferably 45 or less, more preferably 44 or less, and even more preferably 43 or less. By causing the slab hardness H7 of the cover composition to be 45 or less, the spin rate upon an approach shot with a short iron is enhanced. As a result, a golf ball with excellent controllability upon an approach shot is obtained. In order to ensure a sufficient spin rate upon an approach shot, the slab hardness H7 in Shore D hardness of the cover composition is preferably 20 or more, more preferably 23 or more, and even more preferably 25 or more.

In the preferable golf ball construction A, the thickness of the cover of the golf ball is preferably 1 mm or less, more preferably 0.9 mm or less, and even more preferably 0.8 mm or less. If the thickness of the cover is 1 mm or less, the resilience and shot feeling become better. The thickness of the cover is preferably 0.1 mm or more, more preferably 0.2 mm or more, and even more preferably 0.3 mm or more. If the thickness of the cover is less than 0.1 mm, it becomes difficult to mold the cover. In addition, the durability and the abrasion resistance of the cover may deteriorate. Herein, the thickness is measured at the portion where the dimples are not formed, that is the thickness under the land 12 (refer to FIG. 3), unless otherwise described. The thicknesses measured at least 4 portions are averaged.

When the golf ball in the preferable golf ball construction A has a diameter in a range from 40 mm to 45 mm, a compression deformation amount of the golf ball (an amount of compression of the golf ball in the compression direction thereof) when applying a load from an initial load of 98 N to a final load of 1275 N to the golf ball is preferably 2.0 mm or more, more preferably 2.1 mm or more, and even more preferably 2.2 mm or more, and is preferably 3.3 mm or less, more preferably 3.2 mm or less, and even more preferably 3.1 mm or less. By causing the compression deformation amount to be 2.0 mm or more, desirable shot feeling is obtained. By causing the compression deformation amount to be 3.3 mm or less, desirable repulsion is obtained.

Next, the preferable construction B will be explained. In the following explanation, an inner core is defined as a sphere consisting of the center 31 and the intermediate layer 33, a surrounding layer is defined as the intermediate layer 33, and the ouster core 36 is defined as a sphere consisting of the center 31 and two intermediate layers 33, 35 in FIG. 2.

In the case that the surrounding layer is formed from the surrounding layer composition comprising a rubber composition as a main component (50 mass % or more), the center preferably has a diameter of 5.0 mm or more, more preferably 10.0 mm or more and preferably has a diameter of 35.0 mm or less, more preferably 30.0 mm or less. If the center has a diameter of 5.0 mm or more, the relatively soft center functions better, especially the spin rate on the W#1 driver shots is decreased. On the other hand, if the center has a diameter of 35.0 mm or less, the thickness of the surrounding layer, intermediate layer and the cover layer does not become excessively thin, and each layer functions well.

When the center has a diameter from 5.0 mm to 35.0 mm, the center preferably has a compression deformation amount (an compression amount of the center in the compression direction thereof) of 4.0 mm or more, more preferably 4.5 mm or more, and preferably has a compression deformation amount of 10.0 mm or less, more preferably 8.0 mm or less, when applying a load from an initial load of 98 N to a final load of 1275 N. If the compression deformation amount is 4.0 mm or more, the shot feeling becomes better, while if the compression deformation amount is 10.0 mm or less, the repulsion becomes better.

In the case that the surrounding layer is formed from the surrounding layer composition comprising a resin composition as a main component (50 mass % or more), the center preferably has a diameter of 31.0 mm or more, more preferably 35.0 mm or more and preferably has a diameter of 41.0 mm or less, more preferably 40.0 mm or less. If the center has a diameter of 31.0 mm or more, the intermediate layer and the cover layer can be made thinner, thus the repulsion of the golf ball is further improved. On the other hand, if the center has a diameter of 41.0 mm or less, the thickness of the intermediate layer and the cover layer does not become excessively thin, and thus the intermediate layer and the cover layer functions well.

When the center has a diameter from 31.0 mm to 41.0 mm, the center preferably has a compression deformation amount (an compression amount of the center in the compression direction thereof) of 2.0 mm or more, more preferably 2.5 mm or more, and preferably has a compression deformation amount of 5.0 mm or less, more preferably 4.0 mm or less, when applying a load from an initial load of 98 N to a final load of 1275 N. If the compression deformation amount is 2.0 mm or more, the shot feeling becomes better, while if the compression deformation amount is 5.0 mm or less, the repulsion becomes better.

In the case of using the surrounding layer composition containing a rubber composition as a main component (50 mass % or more), the surrounding layer preferably has a thickness of 3.0 mm or more, more preferably 5.0 mm or more, even more preferably 7.0 mm or more, and preferably has a thickness of 17.0 mm or less, more preferably 15.0 mm or less, even more preferably 13.0 mm or less. In the case of using the surrounding layer composition containing the resin composition as a main component (50 mass % or more), the surrounding layer preferably has a thickness of 0.2 mm or more, more preferably 0.4 mm or more, even more preferably 0.6 mm or more, and preferably has a thickness of 3.0 mm or less, more preferably 2.5 mm or less, even more preferably 2.0 mm or less. If the thickness of the surrounding layer is not less than the lower limit of the above range, the effect of the surrounding layer becomes large and thus the effect of suppressing the spin rate on the driver shot becomes larger. If the thickness is not more than the upper limit of the above range, the effect of the core becomes large and thus the repulsion becomes better.

The diameter of the inner core in the preferable construction B is preferably 38.0 mm or more, more preferably 38.5 mm or more, and even more preferably 39 mm or more, and is preferably 42.0 mm or less, more preferably 41.5 mm or less, and even more preferably 41.0 mm or less. If the diameter of the inner core falls within the above range, the effect of suppressing the spin rate on the driver shots is further improved.

When the inner core has a diameter from 38.0 mm to 42.0 mm, the core preferably has a compression deformation amount (an compression amount of the core in the compression direction thereof) of 2.0 mm or more, more preferably 2.2 mm or more, even more preferably 2.3 mm or more, and preferably has a compression deformation amount of 4.0 mm or less, more preferably 3.8 mm or less, even more preferably 3.7 mm or less, when applying a load from an initial load of 98 N to a final load of 1275 N. If the compression deformation amount is 2.0 mm or more, the effect of suppressing the spin rate on the driver shot and the shot feeling are further improved. On the other hand, if the compression deformation amount is 4.0 mm or less, the resilience becomes better.

It is preferable that the inner core in the preferable construction B has a larger surface hardness H4 than the center hardness H1. The hardness difference (H4–H1) between the surface hardness H4 and the center hardness H1 of the inner core in the preferable construction B is preferably 10 or larger, more preferably 15 or larger, even more preferably 20 or more in JIS-C hardness. Making the surface hardness of the inner core larger than the center hardness increases the launch angle and decreases the spin rate, thereby improving the flight distance of the golf ball. The hardness difference (H4–H1) between the surface hardness H4 and the center hardness H1 of the inner core is, without limitation, preferably 40 or less, more preferably 38 or less, even more preferably 36 or less in JIS-C hardness. If the hardness difference is too large, the durability of the golf ball tends to be low.

The center hardness H1 of the inner core is preferably 45 or larger, more preferably 50 or larger, and even more preferably 52 or larger in JIS-C hardness. If the center hardness H1 is 45 or larger in JIS-C hardness, the inner core does not become too soft, resulting in the good repulsion. The center hardness H1 of the inner core is preferably 75 or smaller, more preferably 70 or smaller, and even more preferably 68 or smaller in JIS-C hardness. If the center hardness H1 is 75 or less in JIS-C hardness, the inner core does not become too hard, resulting in the good shot feeling. In the present invention, the center hardness H1 of the core is the hardness measured with the JIS-C type spring hardness tester at the central point of a cut plane of a core which has been cut into two halves.

The surface hardness H4 of the inner core is preferably 73 or larger, more preferably 75 or larger, and even more preferably 77 or larger in JIS-C hardness. If the surface hardness H4 is 73 or larger in JIS-C hardness, the inner core does not become too soft, and the good resilience would be obtained. The surface hardness H4 of the inner core is preferably 102 or smaller, more preferably 100 or smaller, and even more preferably 98 or smaller in JIS-C hardness. If the surface hardness H4 is 102 or smaller in JIS-C hardness, the hardness difference from the intermediate layer can be made large, thus the effect of lowering the spin rate on the driver shots becomes larger.

The thickness of the intermediate layer is preferably 0.3 mm or more, more preferably 0.4 mm or more, and even more preferably 0.5 mm or more, and is preferably 2.0 mm or less, more preferably 1.7 mm or less, and even more preferably 1.5 mm or less. By making the thickness of the intermediate layer to be 0.3 mm or more, the effect of the intermediate layer becomes large and thus the effect of suppressing the spin rate on the driver shots is further improved. In addition, by causing the thickness of the intermediate layer to be 2.0 mm or less, the lowering of the shot feeling can be suppressed.

The surface hardness H6 of the outer core (intermediate layer) is preferably 83 or more, more preferably 85 or more, even more preferably 87 or more, and is preferably 104 or less, more preferably 102 or less, even more preferably 100 or less in JIS-C hardness. If the surface hardness H6 is 83 or more in JIS-C hardness, the hardness and stiffness of the intermediate layer is high, and thus the effect of suppressing the spin rate on the driver shots is further improved. If the surface hardness H6 of the intermediate layer is 104 or less in JIS-C hardness, the hardness of the intermediate layer does not become excessively high, and thus the durability and the shot feeling of the golf ball are further improved.

The hardness difference between the surface hardness (H6) of the outer core (intermediate layer) and the surface hardness (H4) of the inner core is preferably 1 or more, more preferably 2 or more, even more preferably 3 or more, and is preferably 13 or less, more preferably 12 or less, even more preferably 11 or less in JIS-C hardness. If the surface hardness difference (H6–H4) falls within the above range, the spin rate becomes lower and the distance is improved.

The shape of the outer core normally has a spherical shape, but the outer core preferably has dimples on the surface thereof at the positions corresponding to the dimples of the cover. As a result, the cover having a nearly uniform thickness at the dimple bottom portion and a land portion is obtained. On the other hand, the inner core generally has the spherical shape, but the inner core may be provided with a rib on the surface thereof so that the surface of the spherical inner core is divided by the ribs. For example, the surface of the spherical inner core is preferably evenly divided by the ribs. In one embodiment, the ribs are preferably formed on the surface of the inner core in an integrated manner, and in another embodiment, the ribs are formed as a surrounding layer on the surface of the spherical center.

The ribs are preferably formed along an equatorial line and meridians that evenly divide the surface of the spherical inner core, if the spherical inner core is assumed as the earth. For example, if the surface of the spherical inner core is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to obtain the spherical shape. The shape of the ribs, without limitation, includes an arc or an almost arc (for example, a part of the arc is removed to obtain a flat surface at the cross or orthogonal portions thereof).

In the preferable golf ball construction B, the slab hardness H7 of the cover is preferably 45 or less, more preferably 44 or less, and even more preferably 43 or less in Shore D hardness. If the slab hardness H7 of the cover is 45 or less in Shore D hardness, the spin performance on the approach shots with a short iron or the like is enhanced. As a result, a golf ball with excellent controllability on approach shots is obtained. The slab hardness H7 of the cover is preferably 20 or more, more preferably 22 or more in Shore D hardness. If the slab hardness H7 of the cover is less than 20 in Shore D hardness, the spin rate on the approach shots with a short iron or the like may become too high. Herein, the slab hardness H7 of the cover is a measured hardness of the cover composition that is molded into a sheet form by a measuring method described later.

In the preferable golf ball construction B, the thickness of the cover of the golf ball is preferably 1.0 mm or less, more preferably 0.9 mm or less, even more preferably 0.8 mm or less. If the cover has a thickness of 1.0 mm or less, the effect of suppressing the spin rate on the driver shot and the shot feeling are further improved. The thickness of the cover is preferably 0.1 mm or more, more preferably 0.15 mm or more. If the thickness is 0.1 mm or more, the spin performance on the approach shots become better. Herein, the thickness is measured at the portion where the dimples are not formed, that is the thickness under the land 12 (refer to FIG. 3), unless otherwise described. The thicknesses measured at least 4 portions are averaged.

When the golf ball of the present invention has a diameter in a range from 40 mm to 45 mm, a compression deformation amount of the golf ball (deformation amount of the golf ball in the compression direction thereof) when applying a load from an initial load of 98 N to a final load of 1275 N to the golf ball is preferably 2.0 mm or more, more preferably 2.1 mm or more, and even more preferably 2.2 mm or more, and is preferably 3.3 mm or less, more preferably 3.2 mm or less, and even more preferably 3.1 mm or less. By causing the compression deformation amount to be 2.0 mm or more, desirable shot feeling is obtained. By causing the compression deformation amount to be 3.0 mm or less, desirable resilience is obtained.

Adhesion Promoting Layer

As described above, the adhesion promoting layer may be formed between the intermediate layer and the cover in order to enhance the adhesion between the intermediate layer and the cover. In view of suppressing the wrinkles, the adhesion promoting layer preferably has a thickness of 3 μm or more, more preferable 5 μm or more, and preferably has a thickness of 300 μm or less, more preferably 50 μm or less, even more preferably 20 μm or less. The thickness is, for example, determined by observing the cross-sectional plane of the golf ball with a microscope.

Dimples

The golf ball of the present invention preferably has dimples on the surface of the golf ball body. The dimple patterns (shape, number, surface coverage, etc.) are disclosed in U.S. Pat. Nos. 7,621,827, 7,320,651, 7,331,879, 7,291,077, 7,291,077, 7,387,582, and 7,252,602, and U.S. Pat. Publication Nos. 2009/0102097, 2009/0191982 and 2007/0298908, the entire disclosures of which are incorporated by reference herein.

Figure 3:
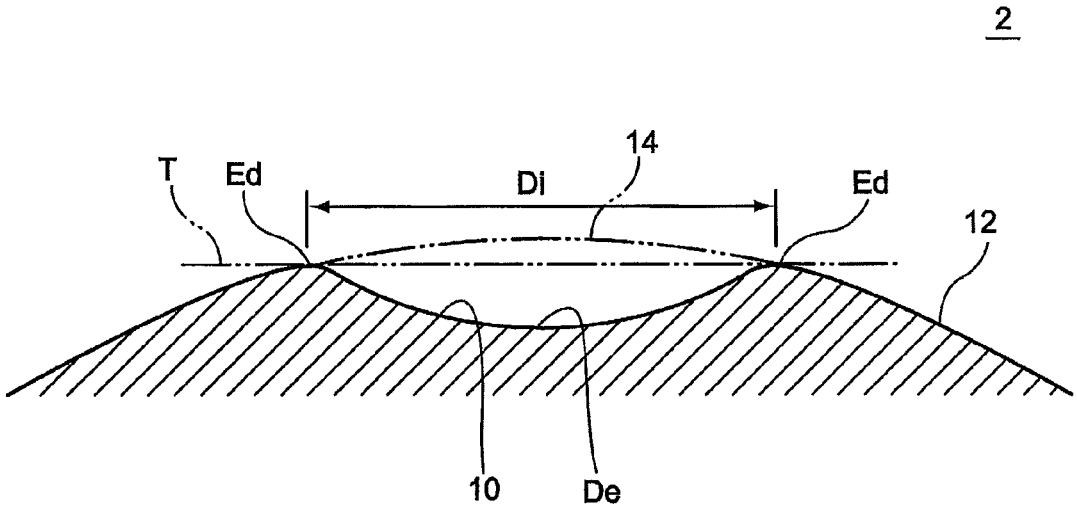
FIG. 3 is an expanded sectional view of the dimples formed on the surface of the golf ball body.

FIG. 3 is an expanded sectional view of a part of a golf ball 2. This figure shows a cross-section which includes the deepest part De of a dimple 10 and the center of the golf ball 2. The up and down direction in FIG. 3 is the depth direction of the dimple 10. The depth direction is the direction from the gravity center of the area of the dimple 10 to the center of the golf ball 2. A chain double-dashed line 14 in FIG. 3 shows an outline of a virtual sphere 14. The outline of the virtual sphere 14 is the surface of the golf ball 2 in the case of assuming that there is no dimple 10. A land 12 is a portion where dimples are not formed on the surface of the golf ball.

Two headed arrow Di in FIG. 3 shows the diameter of the dimple 10. The diameter Di is the furthest distance from one contact point Ed to another contact point Ed when a common tangent line T is drawn in both sides of the dimple 10. The contact points Ed are edges of the dimple 10. The edges Ed define the outline of the dimple 10. The diameter Di is preferably 2.0 mm or more and 6.0 mm or less. If the diameter Di is less than the above range, the dimple effect is hardly obtained and if the diameter Di exceeds 6.0 mm, the intrinsic property of the golf ball 2, that is, it is substantially spherical, is lost. The volume of the dimple means the volume of the portion surrounded with the curved plane including the outline of the dimple 10 and the virtual sphere 14. The total volume of the dimples 10 is preferably 250 $mm^3$ or more and 400 $mm^3$ or less. If the total volume is less than 250 $mm^3$, a hopping trajectory may be provided in some cases. If the total volume exceeds 400 $mm^3$, a dropping trajectory may possibly be provided. In FIG. 3, the distance between the tangent line T and the deepest point De is the depth of the dimple 10. The depth is preferably 0.05 mm or more and 0.60 mm or less. If the depth is less than 0.05 mm, a hopping trajectory may be provided in some cases. On the other hand, if the depth exceeds 0.60 mm, a dropping trajectory may possibly be provided.

The total number of the dimples 10 formed on the cover is preferably 200 or more and 500 or less. If the total number is less than 200, the dimple effect is hardly obtained. On the other hand, if the total number exceeds 500, the dimple effect is hardly obtained because the size of the respective dimples 10 is small. The shape (shape in a plan view) of dimples 10 includes, for example, without limitation, a circle, polygonal shapes such as roughly triangular shape, roughly quadrangular shape, roughly pentagonal shape, and roughly hexagonal shape, another irregular shape. The shape of the dimples is employed solely or in combination at least two of them.

Figure 4:
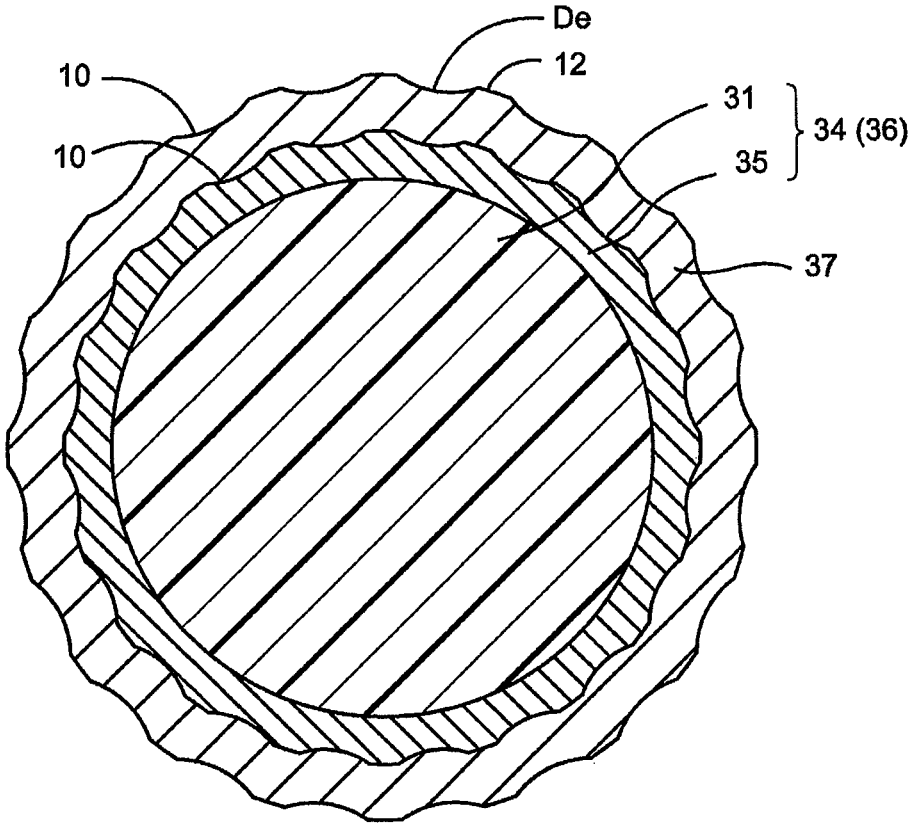
FIG. 4 is a cross sectional view illustrating the cover having a nearly uniform thickness at the dimple bottom portion and the land portion.
Figure 5:
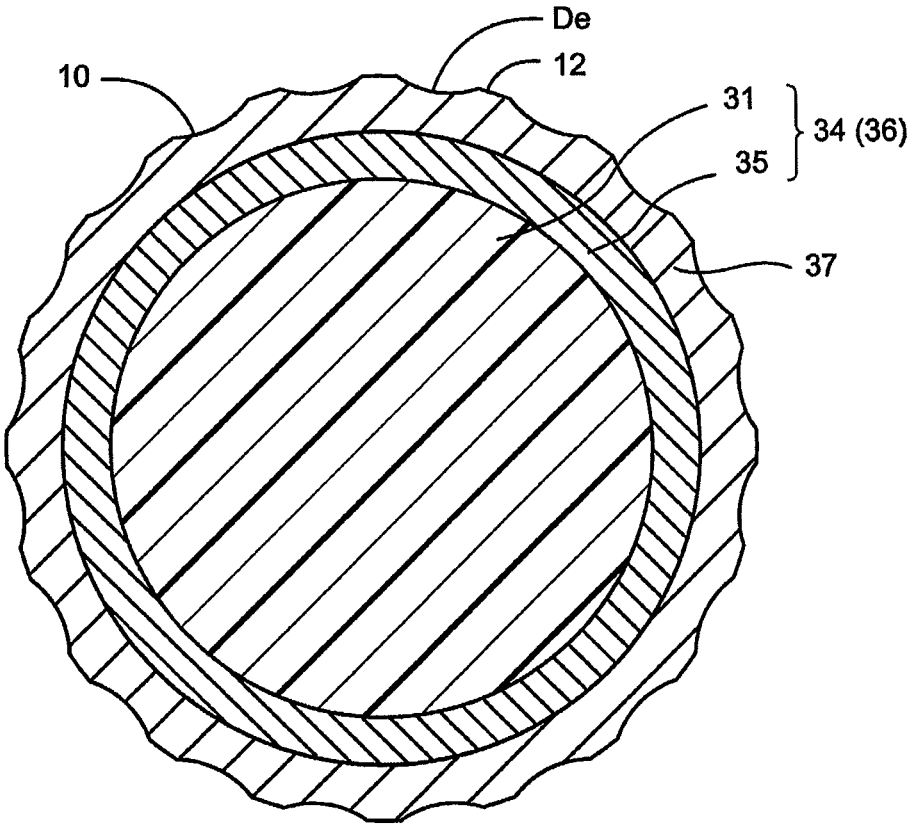
FIG. 5 is a cross sectional view illustrating the cover having a non-uniform thickness at the dimple bottom portion and the land portion.

In one preferable embodiment, the cover has a plurality of dimples and a nearly uniform thickness at both a dimple bottom portion and a land portion. The cover having a nearly uniform thickness at both a dimple bottom portion and a land portion improves the durability of the cover. The cover having a nearly uniform thickness at both a dimple bottom portion and a land portion is, for example, formed by employing the core or intermediate layer having dimples on the surface thereof at the corresponding positions where the dimples of the cover are formed. FIG. 4 shows an example of the golf ball with the cover having a plurality of dimples and a nearly uniform thickness at both a dimple bottom portion and a land portion. The core 34 has dimples 10 on the surface thereof at the portion corresponding to the dimples 10 of the cover. Thus, the cover 37 has a nearly uniform thickness at both the dimple bottom portion De and the land portion 12. On the other hand, FIG. 5 shows an example of the golf ball with the cover having a non-uniform thickness at the dimple bottom portion De and the land portion 12. It is apparent that the thickness at the land portion 12 is thicker than that of the dimple bottom portion De.

Figure 6:
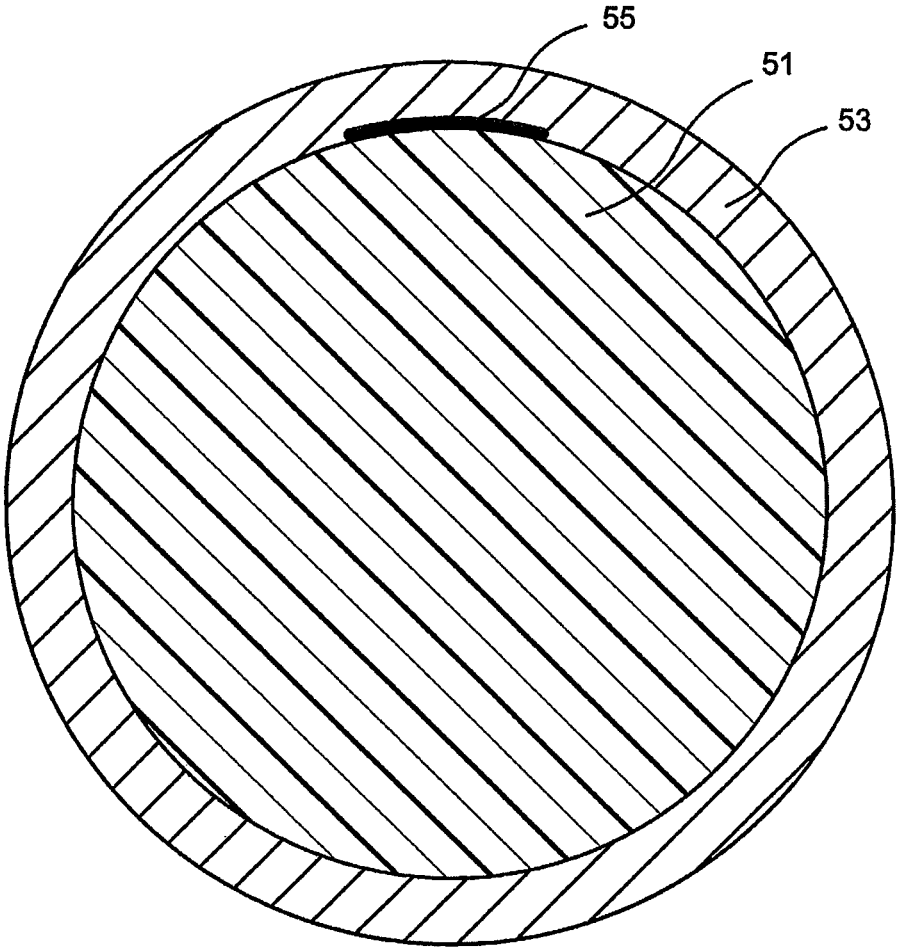
FIG. 6 is a cross sectional view schematically showing one embodiment of forming the paint layer and the mark.
Figure 7:
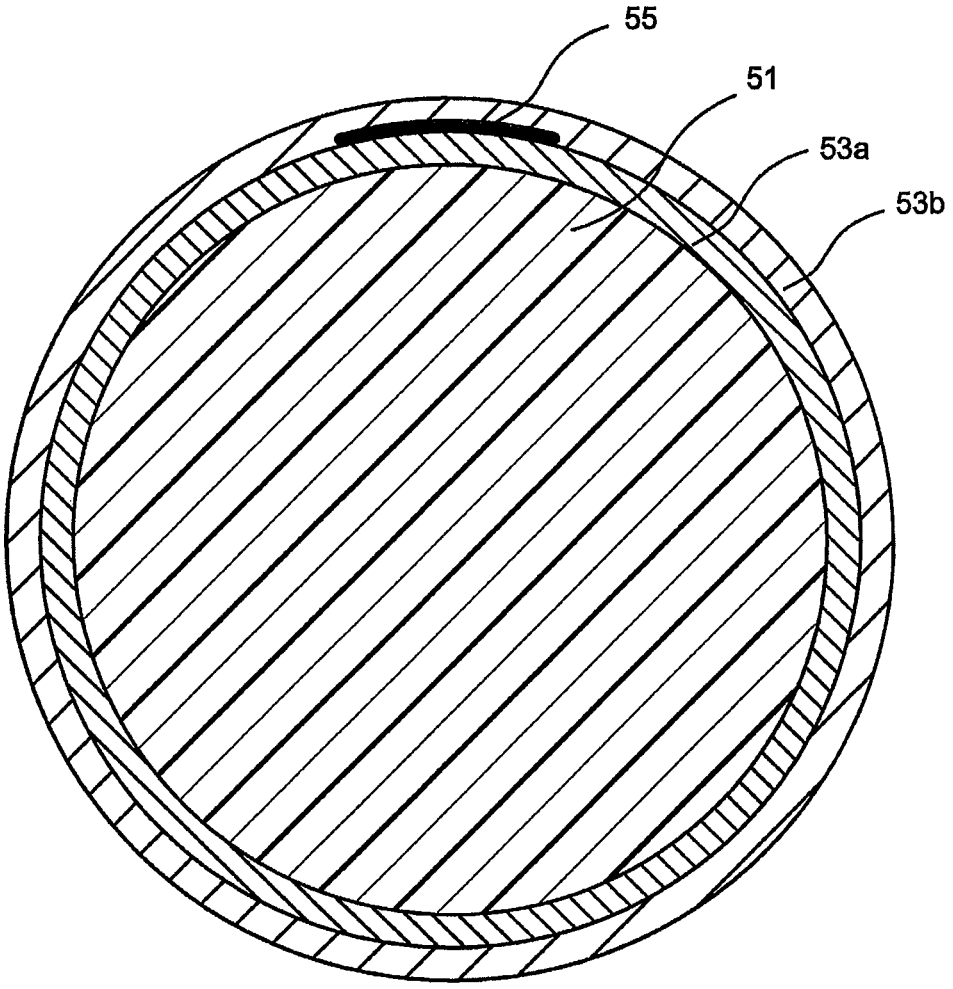
FIG. 7 is a cross sectional view schematically showing another embodiment of forming the paint layer and the mark.

In one preferable embodiment, at least one paint layer and the mark is formed on the golf ball body. The paint layer may have a single-layered or multi-layered structure. In the case of the paint layer having a single-layered structure, the mark 55 is formed on the golf ball body 51, and the paint layer 53 is formed over the mark 55 and the golf ball body 51 as depicted in FIG. 6 In the case of the paint layer having a multi-layered structure (preferably two-layered structure), a first paint layer 53*a* is preferably formed on the golf ball body 51, the mark 55 is formed on the first paint layer 53*a*, and the second paint layer 53*b* is formed over the mark 55 and the first paint layer 53*a*, as depicted in FIG. 7 Forming the mark between the first paint layer and the second paint layer improves the durability of the mark. In this embodiment, it is preferable that the first paint layer 53*a* contain a luster material but the second paint layer 53*b* does not contain a luster material. If the luster material is contained in the first paint layer 53*a*, the golf ball develops a pearlecent luster as a whole. Further, the second paint layer 53*b* provides the gloss to the golf ball without deteriorating the clear visibility of the mark 55.

The paint film preferably has a total thickness of, but not limited to, 5 μm or larger, more preferably 6 μm or larger, even more preferably 7 μm or larger, and preferably has a thickness of 50 μm or smaller, more preferably 45 μm or smaller, even more preferably 40 μm or smaller. This is because if the total thickness is smaller than 5 μm, the paint film is easy to wear off due to continued use of the golf ball, and if the total thickness is larger than 50 μm, the effect of the dimples is reduced, resulting in deteriorating flying performance of the golf ball.

Method for Producing the Golf Ball

Next, the method for producing the golf ball of the present invention will be explained.

The center can be obtained by mixing, kneading the above mentioned rubber composition and molding the rubber composition in the mold. The conditions for press-molding the center rubber composition should be determined depending on the rubber composition. Specifically, the press-molding is preferably carried out for 10 to 60 minutes at the temperature of 130° C. to 200° C. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

The surrounding layer is formed by, for example, covering the center with the surrounding layer composition. Examples of the method for forming the surrounding layer includes, without any limitation, a method which comprises molding the surrounding layer composition into a hemispherical hollow-shell, covering the center with two half hollow-shells and subjecting the center to the press-molding under the condition of 130° C. to 170° C. for 1 to 5 minutes or a method which comprises directly injection-molding the surrounding layer composition onto the center, thereby covering the center with the surrounding layer composition.

An embodiment for molding an intermediate layer is not particularly limited, and includes an embodiment which comprises injection molding the intermediate layer composition directly onto the center, or an embodiment which comprises molding the intermediate layer composition into a hollow-shell, covering the center with a plurality of the hollow-shells and subjecting the center with a plurality of the hollow shells to the compression-molding (preferably an embodiment which comprises molding the intermediate layer composition into a half hollow-shell, covering the center with the two half hollow-shells, and subjecting the center with the two half hollow-shells to the compression-molding).

In the case of directly injection molding the intermediate layer composition onto the center, it is preferred to use upper and lower molds for forming the intermediate layer having a hemispherical cavity and pimples, wherein a part of the pimple also serves as a retractable hold pin. When forming the intermediate layer by injection molding, the hold pin is protruded to hold the center, and the intermediate layer composition which has been heated and melted is charged and then cooled to obtain a cover. For example, the intermediate layer composition heated and melted at the temperature of 150° C. to 230° C. is charged into a mold held under the pressure of 980 KPa to 1,500 KPa for 0.1 to 1 second. After cooling for 15 to 60 seconds, the mold is opened.

When molding the intermediate layer in a compression molding method, molding of the half shell can be performed by either compression molding method or injection molding method, and the compression molding method is preferred. The compression-molding of the intermediate layer composition into half shell can be carried out, for example, under a pressure of 1 MPa or more and 20 MPa or less at a temperature of −20° C. or more and 70° C. or less relative to the flow beginning temperature of the intermediate layer composition. By performing the molding under the above conditions, a half shell having a uniform thickness can be formed. Examples of a method for molding the intermediate layer using half shells include compression molding by covering the center with two half shells. The compression molding of half shells into the intermediate layer can be carried out, for example, under a pressure of 0.5 MPa or more and 25 MPa or less at a temperature of −20° C. or more and 70° C. or less relative to the flow beginning temperature of the intermediate layer composition. By performing the molding under the above conditions, the intermediate layer having a uniform thickness can be formed.

The molding temperature means the highest temperature where the temperature at the surface of the concave portion of the lower mold reaches from closing through opening the molds. Further, the flow beginning temperature of the material can be measured in a pellet form with the following conditions by using a flow characteristics evaluation apparatus (Flow Tester CFT-500D, manufactured by Shimadzu Corporation).

Measuring conditions: Area size of a plunger: 1 $cm^2$, Die length: 1 mm, Die diameter: 1 mm, Load: 588.399 N, Start temperature: 30° C., and Temperature increase rate: 3° C./min.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case of directly injection molding the cover composition onto the core, it is preferred to use upper and lower molds for forming a cover having a hemispherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

When molding the cover in a compression molding method, molding of the half shell can be performed by either compression molding method or injection molding method, and the compression molding method is preferred. The compression-molding of the cover composition into half shell can be carried out, for example, under a pressure of 1

MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a golf ball cover having a uniform thickness can be formed.

When molding a cover, the concave portions called "dimple" are usually formed on the surface.

In a compression molding method, if the molding conditions where the intermediate layer composition exhibits the plastic property is employed, dimples are formed on both surfaces of the intermediate layer and the cover. Thus, the cover having a nearly uniform thickness is obtained. In this case, the compression molding of half shells into the cover can be carried out, for example, under a pressure of 0.5 MPa or more and 25 MPa or less at a temperature of 130° C. or more and 170° C. or less, which is preferably higher than the flow beginning temperature of the intermediate layer composition.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed.

A method for applying the two-component curing type urethane paint is not limited, and any method of applying two-component mixing type paint may be used. For example, a base material such as a polyol composition is mixed with a curing agent such as polyisocyanate, and the obtained mixture is applied to the golf ball with an air gun or by an electrostatic coating method. Further, the golf ball may be previously subjected to surface treatments such as cleaning or sandblast. In the case of applying the paint with the air gun, a base material such as a polyol composition and a curing agent such as polyisocyanate can be mixed little by little for use, or a polyol composition and a polyisocyanate are fed with the respective pumps and continuously mixed in a constant ratio through the line mixer such as the static mixer located in the stream line just before the air gun. Alternatively, a polyol composition and a polyisocyanate can be air-sprayed respectively with the spray gun having the device for controlling the mixing ratio thereof.

Further, when the paint is applied to the golf ball with an air gun, the paint is preferably overpainted to the golf ball multiple times while applying a small amount of the paint at one time until the paint film has a desired thickness.

The applied amount of the paint per one painting operation is preferably 50 mg or more, more preferably 60 mg or more, even more preferably 70 mg or more, and is preferably 160 mg or less, more preferably 150 mg or less, and even more preferably 140 mg or less. Further, the times for overpainting are not limited, as long as the times are at least two times, and may be changed appropriately depending upon a desired film thickness. For example, when the desired film thickness is 10 μm, it is particularly preferable that the times for overpainting are two times.

Subsequently, the two-component curing type urethane paint applied to the golf ball body is dried, for example, at a temperature ranging from 30° C. to 70° C. for 1 to 24 hours to form a paint film.

In one preferable embodiment, the mark may be formed by a pad printing method with the ink composition.

EXAMPLES

Hereinafter, the present invention will be described in detail by way of example. The present invention is not limited to examples described below. Various changes and modifications can be made without departing from the spirit and scope of the present invention.

[Evaluation]

(1) Color Tone

Color tones of the intermediate layers, covers and paint layers were measured using a color difference meter named "CR-221" manufactured by MINOLTA CO using a pulse xenon lamp as a light source. The measurement was conducted on ball, not a slab. That is, the color tone of the intermediate layer was measured in a state of the core where the intermediate layer was formed on the center. The color tone of the cover was measured in a state of the golf ball body where the cover was formed on the core. The color tone of the paint layer was measured in a state of the golf ball where the paint layer was formed on the golf ball body.

(2) Surface Hardness of Center, Inner Core and Outer Core (JIS-C Hardness)

A type P1 auto loading durometer manufactured by Kobunshi Keiki Co., Ltd., provided with a JIS-C type spring hardness tester was used to measure the surface hardness H2 of the center, the surface hardness H4 of the inner core, and the surface hardness H6 of the outer core (intermediate layer). JIS-C hardness measured at the surfaces of the center, the inner core or the outer core were used as the surface hardness H2 of the center, the surface hardness H4 of the inner core, and the surface hardness H6 of the outer core respectively. The core was cut into two hemispheres to obtain a cut plane, and a JIS-C hardness measured at the center of the cut plane was used as the central hardness H1 of the center or the core.

(3) Compression Deformation Amount (mm)

A compression deformation amount of the center, the inner core, the outer core or the golf ball (a shrinking amount of the center, the inner core or the golf ball in the compression direction thereof), when applying a load from an initial load of 98 N to a final load of 1275 N, was measured.

(4) Slab Hardness (Shore D/JIS-C Hardness)

Sheets with a thickness of about 2 mm were produced using a surrounding layer composition, an intermediate layer composition, or a cover composition, and stored at 23° C. for two weeks. Three or more of these sheets were stacked on one another so as not to be affected by the measuring base on which the sheets were placed, and the stack was measured with a type P1 auto loading durometer manufactured by Kobunshi Keiki Co., Ltd., provided with a Shore D/JIS-C type spring hardness tester prescribed in ASTM-D2240 standard. In the case of the surrounding layer composition comprising the rubber composition as a main component, the sheets were produced by hot pressing under the conditions of 140° C. to 180° C. for 10 minutes to 60 minutes.

(5) Density of the Center, Intermediate Layer and Cover

Density was measured by the following method. The electric weight scale AUW220W available from Shimazu Corporation provided with a specific gravity measuring kit and a hood was used. The weight (W1) of the specimen in air was measured and then the weight (W2) of the specimen immersed in ethanol kept at the temperature of about 22° C. was measured. The density (ρ) was calculated by the following equation.

$$\rho = W1/(W1-W2)\times\rho 1$$

W1: weight (g) of the specimen measured in air

W2: weight (g) of the specimen measure in ethanol

ρ1: 0.7875 g/cm$^3$ (density of ethanol at the temperature of about 22° C.)

When measuring the center, the spherical center was used directly for the measurement. When measuring the intermediate layer and the cover layer, the intermediate layer and the cover were separated from the spherical body and the specific gravity thereof was measured.

(6) Flight Distance on a Driver Shot

A metal-headed W#1 driver (XXIO S, loft: 11°, manufactured by SRI Sports Limited) was installed on a swing robot M/C manufactured by Golf Laboratories, Inc. A golf ball was hit at a head speed of 50 m/sec, and the flight distance (the distance from the launch point to the stop point) was measured. This measurement was conducted twelve times for each golf ball, and the average value was used as the measurement value for the golf ball.

(7) Spin Rate on an Approach Wedge

A sand wedge was installed on a swing robot M/C manufactured by Golf Laboratories, Inc. A golf ball was hit with the sand wedge at a head speed of 21 m/sec. The measurement was conducted twelve times for each golf ball, and the average value was used as the spin rate. A sequence of photographs of the hit golf ball were taken to determine the spin rate.

(8) Abrasion Resistance

A commercially available sand wedge (S shaft) was installed on a swing robot M/C manufactured by Golf Laboratories, Inc., and two points of a ball respectively were hit once at the head speed of 36 m/sec. to observe the areas which were hit. Abrasion-resistance was evaluated and ranked into four levels based on following criteria.

E(Excellent): Almost no scratch was present on the surface of the golf ball.

G(Good): Slight scratches were present on the surface of the golf ball, but were not conspicuous.

F(Fair): Scratches were conspicuous, and scuffing could be observed.

P(Poor): The surface of the golf ball was abraded considerably, and scuffing was conspicuous.

(9) Visibility of the Golf Ball in a Cloudy or Rainy Weather

Practical shot test was carried out by ten golfers in both a cloudy and a rainy weather. The visibility of each golf ball during flying and on the ground where the golf ball fell was evaluated according to the following evaluation criteria. More specifically, the visibility of the golf ball during flying means the visibility of the trajectory of the flying golf ball. A major evaluation result from the golfers was determined as the result of each golf ball.

Evaluation Criteria:

G(good): a golf ball was visible both during flying and on the ground.

F(fair): a golf ball was not visible either one of during flying and on the ground.

P(poor): a golf ball was visible neither during flying nor on the ground.

(10) Appearance of Golf Balls

Thirty golfers visually examined the golf balls formed with a paint layer to evaluate the luster based on the following evaluation standards.

E(Excellent): There is a marked pearl luster quality, and appearance is very beautiful.

G(Good): There is a pearl luster quality, and appearance is beautiful.

F(Fair): There is a poor pearl luster quality, and appearance is not very good.

P(Poor): There is essentially no pearl luster quality, and appearance is poor.

(11) Visibility of the Mark

Thirty golfers visually examined the golf ball having a mark thereon and evaluated the visibility of the mark according to the following evaluation standards.

G(Good): Outline of the mark is very sharp and the mark is more visible than usual.

F(Fair): The mark is as visible as usual.

P(Poor): Outline of the mark is blurred and the mark is less visible than usual.

[Production of Two-piece or Three-Piece Golf Balls]

(1) Production of Center

Centers were obtained by kneading rubber compositions having the formulations shown in Table 1, and heat-pressing the kneaded material in upper and lower molds, each having a hemispherical cavity, at 170° C. for 20 minutes.

TABLE 1

| | Center No. | | | |
|---|---|---|---|---|
| | 1 | 2 | 3 | 4 |
| Formulation | | | | |
| Polybutadiene | 100 | 100 | 100 | 100 |
| Zinc acrylate | 34 | 38 | 38 | 34 |
| Zinc oxide | 13.2 | 11.1 | 8.5 | 13.2 |
| Titanium oxide | 5 | 5 | 5 | 5 |
| Diphenyl disulfide | 0.5 | 0.5 | 0.5 | 0.5 |
| Dicumyl peroxide | 0.7 | 1.05 | 0.8 | 0.7 |
| Properties | | | | |
| Diameter (mm) | 39.7 | 39.7 | 40.1 | 41.7 |
| Center hardness (JIS-C hardness) | 65 | 68 | 71 | 65 |
| Surface hardness (JIS-C hardness) | 84 | 86 | 84 | 84 |
| Hardness difference (JIS-C hardness) | 19 | 18 | 13 | 19 |
| Compression deformation amount (mm) | 3.2 | 2.8 | 2.9 | 3.2 |
| Density (g/cm$^3$) | 1.13 | 1.13 | 1.12 | 1.13 |

Notes on table 1:

Formulation: parts by mass

Polybutadiene rubber: "BR-730 (high-cis polybutadiene)" manufactured by JSR Corporation Zinc acrylate: "ZNDA-90S" manufactured by Nihon Jyoryu Kogyo Co., Ltd.

Zinc oxide: "Ginrei R" manufactured by Toho Zinc Co., Ltd.

Titanium oxide: A220 available from ISHIHARA SANGYOU KAISHA, LTD

Diphenyl disulfide: manufactured by Sumitomo Seika Chemicals Co., Ltd.

Dicumyl peroxide: "Percumyl (registered trademark) D" manufactured by NOF Corporation (2) Preparation of Intermediate Layer Composition Blending materials shown in Table 2 were mixed with a twin-screw kneading extruder to prepare intermediate layer compositions in the pellet form. The extruding conditions were a screw diameter of 45 mm, a screw rotational speed of 200 rpm, and screw L/D=35, and the mixtures were heated to 160 to 230° C. at the die position of the extruder.

TABLE 2

| | Intermediate layer composition No. | | | | | | |
|---|---|---|---|---|---|---|---|
| | 1 | 2 | 3 | 4 | 5 | 6 | 7 |
| Himilan 1605 | 50 | 50 | 50 | 50 | 50 | 50 | 50 |
| Himilan AM7329 | 50 | 50 | 50 | 50 | 50 | 50 | 50 |
| Titanium oxide | 0.05 | — | — | — | 0.05 | 4 | 11 |
| Barium sulfate | — | 11 | 11 | — | — | — | — |
| ZQ-17 | 1 | — | — | — | 1 | — | — |
| GPX-17 | — | 4 | 1 | — | — | — | — |
| GPL-15 | — | — | 2 | — | — | — | — |
| Luster material | — | — | — | — | 0.75 | — | — |
| Slab hardness (JIS C/Shore D) | 93/65 | 94/66 | 94/66 | 93/65 | 93/65 | 63/65 | 94/66 |
| Density (g/cm$^3$) | 0.96 | 1.07 | 1.07 | 0.96 | 0.96 | 0.96 | 1.07 |
| Flexural modulus (MPa) | 260 | 290 | 290 | 260 | 260 | 260 | 290 |

Notes on table 2

Formulation: parts by mass

Himilan 1605: Sodium ion neutralized ethylene-methacrylic acid copolymer ionomer resin available from Du Pont-Mitsui Polychemicals Co., Ltd Himilan AM7329: Zinc ion neutralized ethylene-methacrylic acid copolymer ionomer resin available from Du Pont-Mitsui Polychemicals Co., Ltd Titanium oxide: A220 available from ISHIHARA SANGYOU KAISHA, LTD Barium sulfate: "Barium Sulfate BD" manufactured by Sakai Chemical Industry Co., Ltd.

ZQ-17 (Saturn yellow): Coumarin based fluorescent pigment available from Dyglo Color Corp.

GPX-17 (Saturn yellow): Fluorescent pigment available from Dyglo Color Corp.

GPL-15 (blaze orange): Fluorescent pigment available from Dyglo Color Corp.

Luster material: Iriodin 201, a pearl pigment manufactured by MERCK (a luster material comprising mica as a core layer and titanium oxide covering a surrounding of the core layer; a particle size of 5 μm to 25 μm)

(3) Preparation of Cover Composition

Blending materials shown in Table 3 were mixed with a twin-screw kneading extruder to prepare a cover composition in the pellet form. The extruding conditions were a screw diameter of 45 mm, a screw rotational speed of 200 rpm, and screw L/D=35, and the mixtures were heated to 160 to 230° C. at the die position of the extruder.

(4) Production of Core

A spherical core was produced by injection-molding the intermediate layer composition onto the center thus obtained to form an intermediate layer covering the center.

(5) Production of Golf Ball Body

Molding of half shells were performed by charging a pellet of the cover composition into each of the depressed

TABLE 3

| | Cover composition No. | | | | | | | |
|---|---|---|---|---|---|---|---|---|
| | 1 | 2 | 3 | 4 | 5 | 6 | 7 | 8 |
| Elastollan XNY 83A 10 Clear | 100 | — | — | — | 100 | 100 | 100 | — |
| Elastollan XNY 85A 10 Clear | — | 100 | 50 | 50 | — | — | — | 50 |
| Elastollan XNY 90A 10 Clear | — | — | 50 | 50 | — | — | — | 50 |
| WAX master V | 1 | 1 | 1 | 1 | 1 | 1 | 1 | 1 |
| Tinuvin 770 | 0.2 | 0.2 | 0.2 | 0.2 | 0.2 | 0.2 | 0.2 | 0.2 |
| Titanium oxide | 0.05 | 0.05 | 0.05 | 0.05 | — | 0.05 | 4 | — |
| ZQ-17 | 1 | 1 | 1 | — | — | 1 | — | — |
| GPX-17 | — | — | — | 0.5 | — | — | — | — |
| GPX-15 | — | — | — | 1 | — | — | — | — |
| Luster material | — | — | — | — | — | 0.75 | — | — |
| Hardness (Shore D/JIS-C) | 30/45 | 32/47 | 36/50 | 36/50 | 30/45 | 30/45 | 30/45 | 36/50 |
| Density (g/cm$^3$) | 1.07 | 1.07 | 1.07 | 1.07 | 1.07 | 1.07 | 1.07 | 1.07 |

Notes on table 3:

Formulation: parts by mass

Elastollan XNY83A 10 Clear: a thermoplastic polyurethane elastomer manufactured by BASF Japan Ltd.

Elastollan XNY85A 10 Clear: a thermoplastic polyurethane elastomer manufactured by BASF Japan Ltd.

Elastollan XNY90A 10 Clear: a thermoplastic polyurethane elastomer manufactured by BASF Japan Ltd.

WAX master V: BASF Japan Ltd.

Tinuvin 770: hindered amine type light stabilizer available from Ciba Japan K.K.

Titanium oxide: A220 available from ISHIHARA SANGYOU KAISHA, LTD

ZQ-17 (Saturn yellow): Coumarin based fluorescent pigment available from Dyglo Color Corp.

GPX-17 (Saturn yellow): Fluorescent pigment available from Dyglo Color Corp.

GPX-15 (blaze orange): Fluorescent pigment available from Dyglo Color Corp.

Luster material: Iriodin 201, a pearl pigment manufactured by MERCK (a luster material comprising mica as a core layer and titanium oxide covering a surrounding of the core layer; a particle size of 5 μm to 25 μm)

part of the lower mold for molding half shells, and applying pressure to mold half shells. Compression molding was conducted at the temperature of 170° C. for 5 minutes under the molding pressure of 2.94 MPa. The core obtained above was covered with two half shells in a concentric manner and the cover was molded by compression molding. Compression molding was performed at the temperature of 150° C. for 2 minutes under the molding pressure of 9.8 MPa to obtain a golf ball body. The adhesion promoting layer having a thickness about 10 μm was formed on the surface of the core, except the golf ball No. 10 and No. 13. As the adhesion promoting layer, the two-component curing type epoxy resin was used.

Figure 8:
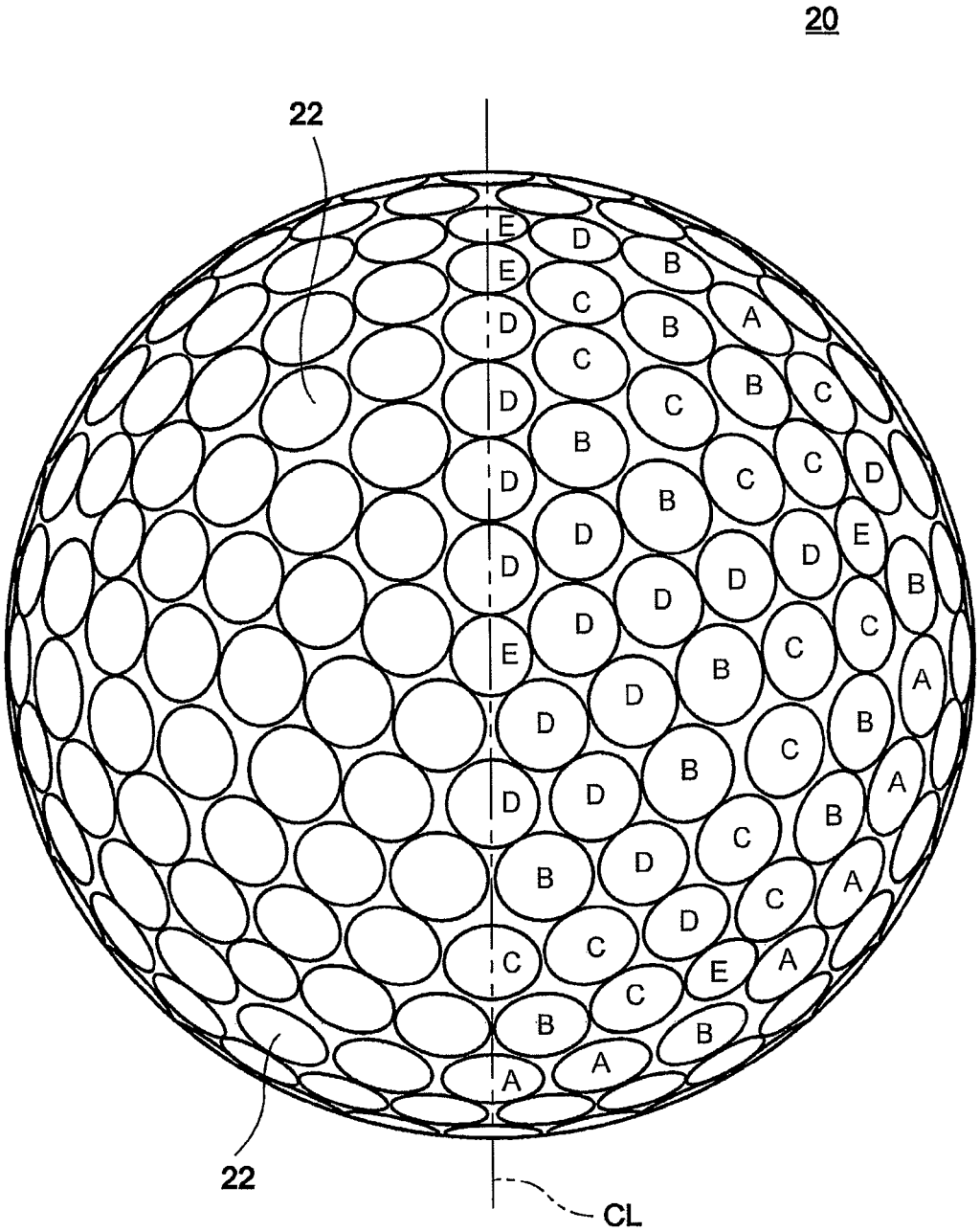
FIG. 8 is a top plan view schematically showing an example of the dimple pattern formed on the surface of the golf ball.
Figure 9:
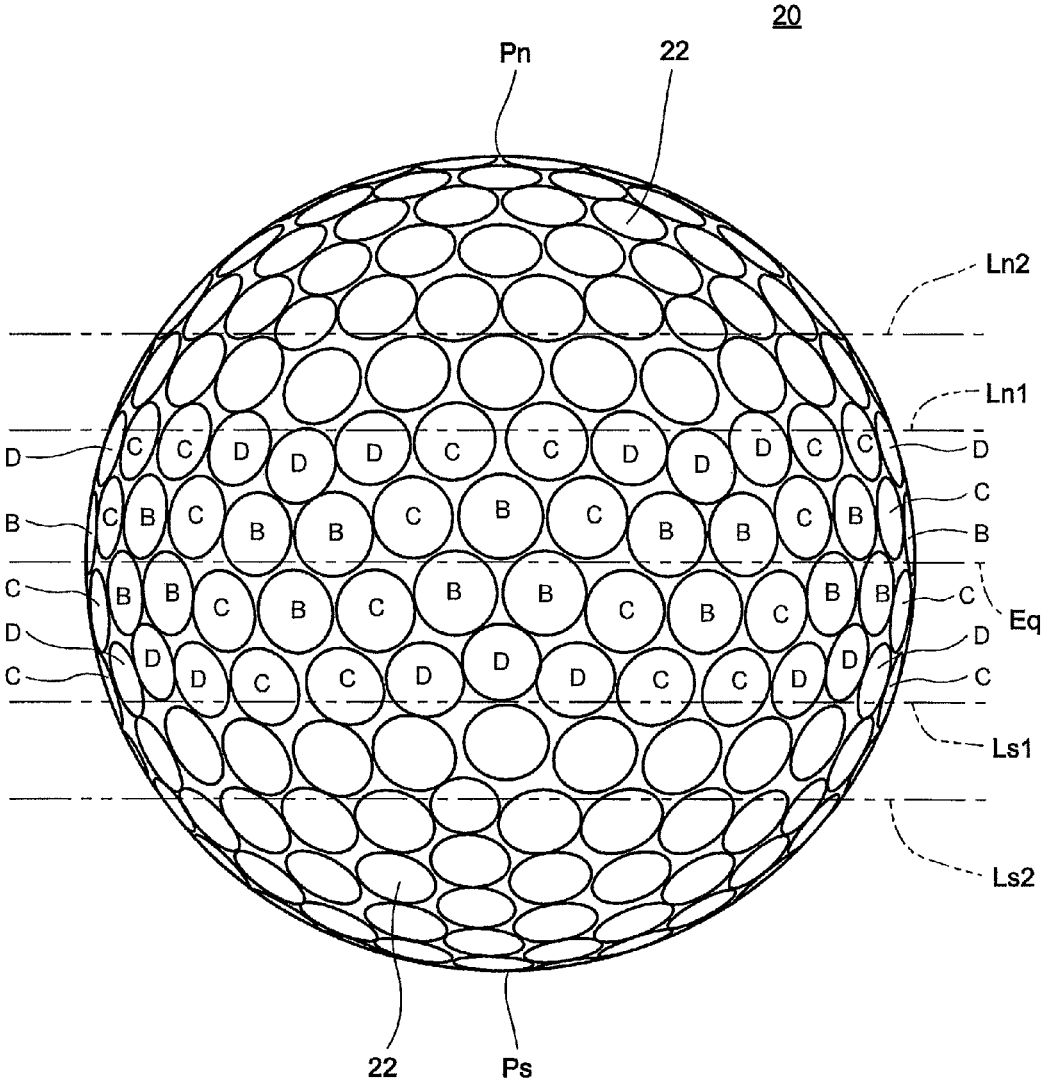
FIG. 9 is a front view schematically showing an example the dimple pattern formed on the surface of the golf ball.

The dimple patterns shown in table 4 and FIG. 8 and FIG. 9 were formed on the surface of the golf ball by compression molding. At the same time, the dimples were also formed on the surface of the core at the portions corresponding the dimples of the cover, thereby forming a cover having a nearly uniform thickness at the dimple bottom portion and the land portion. FIG. 8 shows kinds of dimples 22 by represented symbols A to E formed on the golf ball 22. In FIG. 8, CL means a center line which pass through the center of the golf ball. In FIG. 9, Pn, Ps and Eq mean north pole, south pole, and equator, respectively. Ln1 means a northern latitude line of 20°, and Ln2 mean a northern latitude line of more than 20° and 40° or less. Ls1 means a southern latitude line of 20°, and Ls2 mean a southern latitude line of more than 20° and 40° or less.

TABLE 4

| Kinds | Number | Diameter (mm) | Depth (mm) | Volume ($mm^3$) | Plan view | Front view |
|---|---|---|---|---|---|---|
| A | 26 | 4.50 | 0.142 | 1.131 | FIG. 8 | FIG. 9 |
| B | 88 | 4.40 | 0.142 | 1.081 | | |
| C | 102 | 4.30 | 0.142 | 1.033 | | |
| D | 94 | 4.10 | 0.142 | 0.939 | | |
| E | 14 | 3.60 | 0.142 | 0.724 | | |

(6) Preparation of Paint Composition

The paint compositions were prepared in a following manner.

(i) Base Material: Urethane Polyol 60 parts by mass of PTMG250 (BASF Co., polyoxytetramethyleneglycol having a molecular weight of 250), 54 parts by mass of 550U (Sumitomo-Bayer Urethane Co., Ltd, branched polyol having a molecular weight of 550) were dissolved into 120 parts by mass of the solvent (toluene and methylethylketone). The dibutyl-tin-dilaurylate was added in an amount of 0.1 mass % with respect to the total base material. While keeping this polyol at the temperature of 80° C., 66 parts by mass of isophorone diisocyanate was slow-added into the polyol to obtain a urethane polyol having a solid content of 60 mass %, hydroxyl value of 75 mg KOH/g, and a weight average molecular weight of 7808.

(ii) Curing agent: Isophorone diisocyanate available from Sumitomo-Bayer Urethane Co., LTD.

(iii) Mixing ratio: NCO (curing agent)/OH (base material)= 1.2 molar ratio.

(iv) An UV-absorber, a fluorescent brightener, and a luster material were added into 100 parts by mass of the above two-component curing type urethane resin component to obtain the urethane paint as shown in table 5.

TABLE 5

| Urethane Paint | 1 | 2 | 3 |
|---|---|---|---|
| Two component curing type urethane resin | 100 | 100 | 100 |
| UV-absorber | 0.65 | 0.65 | 0.65 |
| Fluorescent brightener | 0.2 | 0.2 | 0.2 |
| Luster material 1 | — | 10 | — |
| Luster material 2 | — | — | 5 |

Note on table 5

UV-absorber: Tinuvin 234 available from Ciba-Geigy Limited

Fluorescent brightener: Ubitex OB available from Ciba-Geigy

Luster material 1: Iriodin 201, a pearl pigment manufactured by MERCK (a luster material comprising mica as a core layer and titanium oxide covering a surrounding of the core layer; a particle size of 5 μm to 25 μm)

Luster material 2: Iriodin 205, a pearl pigment manufactured by MERCK (a luster material comprising mica as a core layer and titanium oxide covering a surrounding of the core layer; a particle size of 10 μm to 60 μm)

(7) Preparation of Ink Composition

As shown in table 6, the ink composition for the mark was prepared.

TABLE 6

| Formulation | Parts |
|---|---|
| Epoxy resin | 25 |
| Curing agent | 7.5 |
| Solvent | 53.5 |
| Flatting agent | 5 |
| Pigment | 10 |

Epoxy resin: two-component curing type PAD-EPHink available from Navitas Corporation Curing agent: Hexamethylene diisocyanate Solvent: a mixture of 50 mass % methoxymethylbutylacetate, 20 mass % acetylacetone, 6 mass % propyleneglycol monomethylether acetate, 4 mass % ethylacetate, 20 mass % an aromatic hydrocarbon Pigment: Black pigment (8) Formation of Paint Layer and Mark

[Paint-Mark Type No. 1, 2, 4, and 5: Two Paint Layer and the Mark Between them]

A paint composition was applied to the surface of the golf ball body and dried to prepare the $1^{st}$ paint layer. Then, the mark was printed on the $1^{st}$ paint layer using the ink composition shown in Table 6. The mark "X" of width 8 mm, height 8 mm, line width 2 mm was printed by the pad stamp method. Continuously, a paint composition was applied over the mark and the $1^{st}$ paint layer to form the $2^{nd}$ paint layer. The golf ball was kept in an oven at 40° C. for 4 hours to cure the paint composition and the ink composition. Consequently, golf balls having a diameter of 42.7 mm and a mass of 45.4 g were obtained. The details of the paint layer and the mark are summarized in tables No. 7-1 and 7-2.

[Paint-Mark Type No. 3 and 6: One Paint Layer Coating the Mark]

The mark was directly printed on the golf ball body by the pad stamp method, and the paint composition was applied over the mark and the golf ball body. The golf ball was kept in an oven at 40° C. for 4 hours to cure the paint composition and the ink composition. Consequently, golf balls having a diameter of 42.7 mm and a mass of 45.4 g were obtained. The details of the paint layer and the mark are summarized in tables No. 7-1 and 7-2.

TABLE 7-1

| Paint-Mark Type | 1 | 2 | 3 | 4 |
|---|---|---|---|---|
| $1^{st}$ Paint layer | Paint composition 2 | Paint composition 3 | — | Paint composition 1 |

TABLE 7-1-continued

| Paint-Mark Type | 1 | 2 | 3 | 4 |
|---|---|---|---|---|
| Thickness (μm) | 10 μm | 10 μm | — | 5 μm |
| Mark | Ink composition | Ink composition | Ink composition | Ink Composition |
| $2^{nd}$ Paint layer | Paint composition 1 | Paint composition 1 | Paint composition 1 | Paint composition 1 |
| Thickness (μm) | 10 μm | 10 μm | 10 μm | 5 μm |

TABLE 7-2

| Paint-Mark Type | 5 | 6 |
|---|---|---|
| $1^{st}$ Paint layer | Paint composition 1 | — |
| Thickness (μm) | 10 μm | — |
| Mark | Ink composition | Ink composition |
| $2^{nd}$ Paint layer | Paint composition 1 | Paint composition 2 |
| Thickness (μm) | 10 μm | 10 μm |

The evaluation results of the final golf ball are summarized in Tables No. 8 to 11.

TABLE 8

| | | Golf ball No. | | | |
|---|---|---|---|---|---|
| | | 1 | 2 | 3 | 4 |
| | Center No. | 1 | 2 | 3 | 3 |
| Intermediate layer | Intermediate layer composition | 1 | 1 | 2 | 3 |
| | Thickness (mm) | 1.0 | 1.0 | 1.0 | 1.0 |
| | Slab hardness (Shore D/JIS-C) | 65/93 | 65/93 | 66/94 | 66/94 |
| | Density (g/cm$^3$) | 0.96 | 0.96 | 1.07 | 1.07 |
| Core | Diameter (mm) | 41.7 | 41.7 | 42.1 | 42.1 |
| | Compression deformation amount (mm) | 2.9 | 2.5 | 2.6 | 2.6 |
| | Center hardness H1 (JIS-C) | 65 | 68 | 71 | 71 |
| | Surface hardness H6 (Shore D/JIS-C) | 63/94 | 64/95 | 64/92 | 64/92 |
| | Hardness difference (JIS-C) | 29 | 27 | 21 | 21 |
| | L* value | 75 | 75 | 80 | 70 |
| | a* value | −28 | −28 | −33 | 37 |
| | b* value | 49 | 49 | 57 | 56 |
| | Adhesion Promoting Layer | Epoxy | Epoxy | Epoxy | Epoxy |
| Cover | Cover composition No. | 1 | 2 | 3 | 4 |
| | Slab hardness H7 (Shore D) | 30 | 32 | 36 | 36 |
| | Thickness (mm) | 0.5 | 0.5 | 0.3 | 0.3 |
| | L* value | 74 | 74 | 78 | 63 |
| | a* value | −35 | −35 | −34 | 45 |
| | b* value | 50 | 50 | 57 | 57 |
| | ΔE (Cover/Intermediate layer) | 6.9 | 6.9 | 2.9 | 11.0 |
| | Paint Mark Layer type | 1 | 1 | 1 | 2 |
| Golf ball evaluation | Diameter (mm) | 42.7 | 42.7 | 42.7 | 42.7 |
| | Compression deformation amount (mm) | 2.8 | 2.4 | 2.5 | 2.5 |
| | L* value | 76 | 76 | 81 | 64 |
| | a* value | −32 | −32 | −32 | 41 |
| | b* value | 46 | 46 | 55 | 53 |
| | $(a^{*2} + b^{*2})^{1/2}$ | 56 | 56 | 64 | 67 |
| | ΔE (Paint layer/Intermediate layer) | 5.1 | 5.1 | 2.6 | 7.9 |
| | ΔE (Paint layer/Cover) | 5.1 | 5.1 | 4.4 | 5.7 |
| | Visibility (Golf ball) | G | G | G | G |
| | Visibility (mark) | G | G | G | G |
| | Appearance (Golf ball) | E | E | E | E |
| | Shadow of dimples | Non | Non | Non | Non |
| | Flight distance on driver shot (m) | 281 | 282 | 284 | 284 |
| | Spin rate on short iron shot (rpm) | 6700 | 6800 | 6530 | 6530 |
| | Abrasion resistance | G | G | G | G |

TABLE 9

| | | Golf ball No. | | | |
|---|---|---|---|---|---|
| | | 5 | 6 | 7 | 8 |
| | Center No. | 1 | 1 | 1 | 1 |
| Intermediate layer | Intermediate layer composition | 4 | 1 | 1 | 1 |
| | Thickness (mm) | 1.0 | 1.0 | 1.0 | 1.0 |
| | Slab hardness (Shore D/JIS-C) | 65/93 | 65/93 | 65/93 | 65/93 |
| | Density (g/cm$^3$) | 0.96 | 0.96 | 0.96 | 0.96 |
| Core | Diameter (mm) | 41.7 | 41.7 | 41.7 | 41.7 |
| | Compression deformation amount (mm) | 2.94 | 2.94 | 2.94 | 2.94 |
| | Center hardness H1 (JIS-C) | 65 | 65 | 65 | 65 |
| | Surface hardness H6 (Shore D/JIS-C) | 63/94 | 63/94 | 63/94 | 63/94 |
| | Hardness difference (JIS-C) | 29 | 29 | 29 | 29 |
| | L* value | 97 | 75 | 75 | 75 |

TABLE 9-continued

| | | Golf ball No. | | | |
|---|---|---|---|---|---|
| | | 5 | 6 | 7 | 8 |
| | a* value | 0 | −28 | −28 | −28 |
| | b* value | 2 | 49 | 49 | 49 |
| | Adhesion Promoting Layer | Epoxy | Epoxy | Epoxy | Epoxy |
| Cover | Cover composition No. | 1 | 5 | 6 | 6 |
| | Slab hardness H7 (Shore D) | 30 | 30 | 30 | 30 |
| | Thickness (mm) | 0.5 | 0.5 | 0.5 | 0.5 |
| | L* value | 91 | 75 | 76 | 76 |
| | a* value | −23 | −28 | −32 | −32 |
| | b* value | 59 | 49 | 46 | 46 |
| | ΔE (Cover/Intermediate layer) | 62.1 | 0.0 | 5.1 | 5.1 |
| | Paint Mark Layer type | 1 | 1 | 3 | 4 |
| Golf ball evaluation | Diameter (mm) | 42.7 | 42.7 | 42.7 | 42.7 |
| | Compression deformation amount (mm) | 2.8 | 2.8 | 2.8 | 2.8 |
| | L* value | 90 | 74 | 76 | 76 |
| | a* value | −20 | −25 | −32 | −32 |
| | b* value | 50 | 40 | 46 | 46 |
| | $(a^{*2} + b^{*2})^{1/2}$ | 73 | 47 | 56 | 56 |
| | ΔE (Painted ball/Intermediate layer) | 52.5 | 9.9 | 5.1 | 5.1 |
| | ΔE (Paint layer/Cover) | 9.9 | 9.9 | 0.0 | 0.0 |
| | Visibility (Golf ball) | F | F | G | G |
| | Visibility (mark) | G | G | F | F |
| | Appearance (Golf ball) | E | E | G | G |
| | Shadow of dimples | Non | Non | Non | Non |
| | Flight distance on driver shot (m) | 281 | 281 | 281 | 281 |
| | Spin rate on short iron shot (rpm) | 6700 | 6700 | 6700 | 6700 |
| | Abrasion resistance | G | G | G | G |

TABLE 10

| | | Golf ball No. | | | |
|---|---|---|---|---|---|
| | | 9 | 10 | 11 | 12 |
| | Center No. | 1 | 1 | 1 | 1 |
| Intermediate layer | Intermediate layer composition | 5 | 1 | 1 | 6 |
| | Thickness (mm) | 1.0 | 1.0 | 1.0 | 1.0 |
| | Slab hardness (Shore D/JIS-C) | 65/93 | 65/93 | 65/93 | 65/93 |
| | Density (g/cm$^3$) | 0.96 | 0.96 | 0.96 | 0.96 |
| Core | Diameter (mm) | 41.7 | 41.7 | 41.7 | 41.7 |
| | Compression deformation amount (mm) | 2.94 | 2.94 | 2.94 | 2.94 |
| | Center hardness H1 (JIS-C) | 65 | 65 | 65 | 65 |
| | Surface hardness H6 (Shore D/JIS-C) | 63/94 | 63/94 | 63/94 | 63/94 |
| | Hardness difference (JIS-C) | 29 | 29 | 29 | 29 |
| | L* value | 75 | 75 | 75 | 91 |
| | a* value | −26 | −28 | −28 | −1 |
| | b* value | 44 | 49 | 49 | −5 |
| | Adhesion Promoting Layer | Epoxy | Epoxy | Epoxy | Epoxy |
| Cover | Cover composition No. | 1 | 1 | 7 | 7 |
| | Slab hardness H7 (Shore D) | 30 | 30 | 30 | 30 |
| | Thickness (mm) | 0.5 | 0.5 | 0.5 | 0.5 |
| | L* value | 76 | 75 | 90 | 90 |
| | a* value | −30 | −39 | 0 | 0 |
| | b* value | 41 | 46 | −8 | −8 |
| | ΔE (Cover/Intermediate layer) | 5.1 | 11.1 | 65.3 | 3.3 |
| | Paint Mark Layer type | 5 | 1 | 3 | 3 |
| Golf ball evaluation | Diameter (mm) | 42.7 | 42.7 | 42.7 | 42.7 |
| | Compression deformation amount (mm) | 2.8 | 2.8 | 2.8 | 2.8 |
| | L* value | 76 | 77 | 89 | 89 |
| | a* value | −30 | −36 | 0 | 0 |
| | b* value | 41 | 42 | −10 | −10 |
| | $(a^{*2} + b^{*2})^{1/2}$ | 51 | 55 | 10 | 10 |
| | ΔE (Painted ball/Intermediate layer) | 5.1 | 10.8 | 67.0 | 5.4 |
| | ΔE (Paint layer/Cover) | 0.0 | 13.0 | 2.1 | 2.1 |
| | Visibility (Golf ball) | G | E | P | P |
| | Visibility (mark) | F | F | F | F |
| | Appearance (Golf ball) | F | P | P | P |
| | Shadow of dimples | Non | Non | Non | Non |
| | Flight distance on driver shot (m) | 281 | 281 | 281 | 281 |
| | Spin rate on short iron shot (rpm) | 6700 | 6700 | 6700 | 6700 |
| | Abrasion resistance | G | G | G | G |

TABLE 11

| | | Golf ball No. | |
|---|---|---|---|
| | | 13 | 14 |
| | Center No. | 4 | 3 |
| Intermediate layer | Intermediate layer composition | — | 7 |
| | Thickness (mm) | — | 1.0 |
| | Slab hardness (Shore D/JIS-C) | — | 66/94 |
| | Density (g/cm$^3$) | — | 1.07 |
| Core | Diameter (mm) | 41.7 | 42.1 |
| | Compression deformation amount (mm) | 3.2 | 2.58 |
| | Center hardness H1 (JIS-C) | 65 | 71 |
| | Surface hardness H6 (Shore D/JIS-C) | 56/84 | 64/92 |
| | Hardness difference (JIS-C) | 19 | 21 |
| | L* value | 97 | 91 |
| | a* value | 0 | −1 |
| | b* value | 2 | −5 |
| | Adhesion Promoting Layer | Non | Epoxy |
| Cover | Cover composition No. | 1 | 8 |
| | Slab hardness H7 (Shore D) | 30 | 36 |
| | Thickness (mm) | 0.5 | 0.3 |
| | L* value | 75 | 91 |
| | a* value | −35 | −1 |
| | b* value | 64 | −5 |
| | ΔE (Cover/Intermediate layer) | — | 0.0 |
| | Paint Mark Layer type | 3 | 6 |
| Golf ball Evaluation | Diameter (mm) | 42.7 | 42.7 |
| | Compression deformation amount (mm) | 2.8 | 2.5 |
| | L* value | 75 | 88 |
| | a* value | −35 | −1 |
| | b* value | 64 | −8 |
| | $(a^{*2} + b^{*2})^{1/2}$ | 73 | 8 |
| | ΔE (Painted ball/Intermediate layer) | — | 4.2 |
| | ΔE (Paint layer/Cover) | 0 | 4.2 |
| | Visibility (Golf ball) | G | F |
| | Visibility (mark) | F | P |
| | Appearance (Golf ball) | P | G |
| | Shadow of dimples | Non | Non |
| | Flight distance on driver shot (m) | 281 | 281 |
| | Spin rate on short iron shot (rpm) | 6900 | 6900 |
| | Abrasion resistance | G | G |

As apparent from tables No. 8 to 11, Golf balls No. 1 to 10 have an excellent performance, visibility and appearance. Parting line and shadow of dimples were not perceived.

[Production of Four Piece Golf Ball]

A four-piece golf ball was produced in the same way as the three-piece golf balls, except that an inner core consisting of the two layers (center and surrounding layer) as shown table 12 was used instead of the center of the three-piece golf balls.

The Center was obtained by kneading a rubber composition having the formulation shown in Table 12, and heat-pressing the kneaded material in upper and lower molds, each having a hemispherical cavity, at 170° C. for 15 minutes.

The center thus obtained was covered with the surrounding layer composition to form the surrounding layer and obtain inner core. The surrounding layer composition shown in Table 12 was first kneaded and the upper die for molding a center in the state that the center was set therein and a lower die for molding a core were clamped in a manner that a necessary amount of the surrounding layer composition was brought into contact with a half of the surface of the center and heat pressing was carried out to produce an intermediate core molded product having an surrounding layer formed on a half of the surface of the center. Next, the lower die for molding the core in the state that the surrounding layer of the intermediate core molded product was housed and an upper die for molding a core were clamped in a manner that a necessary amount of the surrounding layer composition was brought into contact with the other half of the surface of the center and heat pressing was carried out to produce a core having a surrounding layer on the other half of the surface of the center. Then, the core was heat pressed at the temperature of 170° C. for 20 minutes to form an inner core.

TABLE 12

| Inner core No. | | | 1 |
|---|---|---|---|
| Center | Composition | Polybutadiene | 100 |
| | | Zinc acrylate | 20 |
| | | Zinc oxide | 5 |
| | | Barium sulfate | 17 |
| | | Titanium oxide | 5 |
| | | Diphenyl disulfide | 0.5 |
| | | Dicuyml peroxide | 0.7 |
| | Diameter (mm) | | 15.0 |
| | Density (g/cm$^3$) | | 1.12 |
| Surrounding layer | Composition | Polybutadiene | 100 |
| | | Zinc acrylate | 34.5 |
| | | Zinc oxide | 11.5 |
| | | Titanium oxide | 5 |
| | | Diphenyl disulfide | 0.5 |
| | | Dicumyl peroxide | 0.7 |
| | Thickness (mm) | | 12.35 |
| | Density (g/cm$^3$) | | 1.12 |
| Properties | Diameter (mm) | | 39.7 |
| | Center hardness H1 (JIS-C) | | 60 |
| | Surface hardness H4 (JIS-C) | | 85 |
| | Hardness difference (JIS-C) | | 25 |
| | Compression deformation amount (mm) | | 3.2 |

Note on table 12

Formulation: parts by mass

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Titanium oxide: A220 available from ISHIHARA SANGYOU KAISHA, LTD

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

The results of evaluations of the four piece golf ball were shown in table 13.

TABLE 13

| Golf ball No. | | 15 |
|---|---|---|
| | Inner Core No. | 1 |
| Intermediate layer | Intermediate layer composition | 1 |
| | Thickness (mm) | 1.0 |
| | Slab hardness (Shore D/JIS-C) | 65/93 |
| | Density (g/cm$^3$) | 0.96 |
| Core | Diameter (mm) | 41.7 |
| | Compression deformation amount (mm) | 2.5 |
| | Center hardness H1 (JIS-C) | 60 |
| | Surface hardness H6 (Shore D/JIS-C) | 64/95 |
| | Hardness difference (JIS-C) | 35 |
| | L* value | 75 |
| | a* value | −28 |
| | b* value | 49 |
| | Adhesion Promoting Layer | Epoxy |
| Cover | Cover composition No. | 2 |
| | Slab hardness H7 (Shore D) | 32 |
| | Thickness (mm) | 0.5 |
| | L* value | 74 |
| | a* value | −35 |
| | b* value | 50 |
| | ΔE (Cover/Intermediate layer) | 6.9 |
| | Paint Mark Layer type | 1 |
| Golf ball evaluation | Diameter (mm) | 42.7 |
| | Compression deformation amount (mm) | 2.8 |
| | L* value | 76 |
| | a* value | −32 |
| | b* value | 46 |
| | $(a^{*2} + b^{*2})^{1/2}$ | 56 |
| | ΔE (Paint Layer/Intermediate layer) | 5.1 |

TABLE 13-continued

| Golf ball No. | 15 |
|---|---|
| ΔE (Paint layer/Cover) | 5.1 |
| Visibility (Golf ball) | E |
| Visibility (mark) | G |
| Appearance (Golf ball) | G |
| Shadow of dimples | Non |
| Flight distance on driver shot (m) | 283 |
| Spin rate on short iron shot (rpm) | 6800 |
| Abrasion resistance | G |

As apparent from table 13, Golf ball No. 15 has an excellent performance, visibility and appearance. Parting line and shadow of dimples were not perceived.

The invention claimed is:

1. A colored golf ball having a color other than white and comprising:

a core having a center and at least one intermediate layer disposed around the center, and a cover disposed around the core, wherein at least one intermediate layer contains a fluorescent dye and/or a fluorescent pigment in an amount ranging from 0.5 part to 10 parts with respect to 100 parts by mass of the resin component, contains a low opaque mass adjusting agent consisting of barium sulfate in an amount ranging from 5 parts to 30 parts with respect to 100 parts by mass of a resin component, and has a density of 1.00 g/cm$^3$ or more and less than 1.20 g/cm$^3$;

the cover contains titanium oxide in an amount of more than 0.03 parts and a fluorescent dye and/or a fluorescent in an amount ranging from 0.5 parts to 10 parts with respect to 100 parts by mass of a resin component.

2. The colored golf ball according to claim 1, wherein the golf ball has a color which satisfies the following equations in CIELAB color coordinate system in terms of L*, a*, and b* values $$L^*<85, a^*<-20 \text{ or } a^*>30, b^*>10.$$

3. The colored golf ball according to claim 1, further comprising at least one paint layer.

4. The colored golf ball according to claim 3, wherein the at least one paint layer further comprises a luster material.

5. The colored golf ball according to claim 1, further comprising a first paint layer comprising a luster material and formed on the cover, and a second paint layer formed on the first paint layer, wherein a mark is formed between the first paint layer and the second paint layer.

6. The colored golf ball according to claim 1, wherein the fluorescent dye and/or the fluorescent pigment has a melting point of 180° C. or less.

7. The colored golf ball according to claim 1, wherein the cover contains titanium oxide in an amount of 0.05 parts or more.

8. A colored golf ball having a color other than white and comprising:

a core having a center and at least one intermediate layer disposed around the center, a cover disposed around the core, and at least one paint layer formed on the cover, wherein at least one intermediate layer contains a fluorescent dye and/or a fluorescent pigment in an amount ranging from 0.5 parts to 10 parts with respect to 100 parts by mass of the resin component, contains a low opaque mass adjusting agent consisting of barium sulfate in an amount ranging from 5 parts to 30 parts with respect to 100 parts by mass of a resin component, and has a density of 1.00 g/cm$^3$ or more and less than 1.20 g/cm$^3$;

the cover contains titanium oxide in an amount of 0.03 parts or more and a fluorescent dye and/or a fluorescent pigment in an amount ranging from 0.5 parts to 10 parts with respect to 100 parts by mass of a resin component; and the golf ball has a color which satisfies the following equations in CIELAB color coordinate system in terms of L*, a*, and b* values $$L^*<85, a^*<-20 \text{ or } a^*>30, b^*>10.$$

9. The colored golf ball according to claim 8, wherein the at least one paint layer further comprises a luster material.

10. The colored golf ball according to claim 8, further comprising a first paint layer comprising a luster material and formed on the cover, and a second paint layer formed on the first paint layer, wherein a mark is formed between the first paint layer and the second paint layer.

11. A colored golf ball having a color other than white and comprising:

a core having a center and at least one intermediate layer disposed around the center, a cover disposed around the core, and at least one paint layer formed on the cover, wherein at least one intermediate layer contains a fluorescent dye and/or a fluorescent pigment, contains a low opaque mass adjusting agent consisting of barium sulfate in an amount ranging from 5 parts to 30 parts with respect to 100 parts by mass of a resin component, and has a density of 1.00 g/cm$^3$ or more and less than 1.20 g/cm$^3$;

the cover contains titanium oxide in an amount of 0.03 parts or more and a fluorescent dye and/or a fluorescent pigment in an amount ranging from 0.5 parts to 10 parts with respect to 100 parts by mass of resin component; and a color difference (ΔE*) between the intermediate layer and the cover is 12 or less in the CIELAB color coordinate system.

12. The colored golf ball according to claim 11, wherein the intermediate layer and the paint layer have a color difference (ΔE*) of 12 or less in CIELAB color coordinate system.

13. The colored golf ball according to claim 11, wherein a color difference (ΔE*) between the cover and the paint layer is 12 or less in CIELAB color coordinate system.

* * * * *